US008517111B2

(12) United States Patent
Mix et al.

(10) Patent No.: US 8,517,111 B2
(45) Date of Patent: Aug. 27, 2013

(54) SYSTEMS AND METHODS FOR CIRCULATING OUT A WELL BORE INFLUX IN A DUAL GRADIENT ENVIRONMENT

(75) Inventors: Kurt Edward Mix, Katy, TX (US); Robert L. Myers, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 405 days.

(21) Appl. No.: 12/878,550

(22) Filed: Sep. 9, 2010

(65) Prior Publication Data

US 2011/0061872 A1 Mar. 17, 2011

Related U.S. Application Data

(60) Provisional application No. 61/241,320, filed on Sep. 10, 2009.

(51) Int. Cl.
*E21B 7/12* (2006.01)
*E21B 21/01* (2006.01)

(52) U.S. Cl.
USPC ..... 166/363; 166/347; 166/352; 166/358; 166/250.01; 175/5; 175/217; 405/224.2

(58) Field of Classification Search
USPC ..... 166/363, 344, 347, 351, 352, 358, 166/367, 368, 250.01; 175/5–10, 207, 209, 175/217, 218; 405/224.2–224.4
See application file for complete search history.

(56) References Cited

U.S. PATENT DOCUMENTS 4,042,014 A 8/1977 Scott
4,063,602 A * 12/1977 Howell et al. ..... 175/7
4,091,881 A * 5/1978 Maus ..... 175/7
4,099,583 A 7/1978 Maus
4,291,772 A * 9/1981 Beynet ..... 175/5
4,399,870 A 8/1983 Baugh et al.
4,442,011 A 4/1984 Thaler et al.

(Continued)

FOREIGN PATENT DOCUMENTS

GB 2365044 A 2/2002
GB 2365044 A1 2/2002
WO 01/25593 A1 4/2001

OTHER PUBLICATIONS

Kennedy, J., "First Dual Gradient Drilling System Set for Field Test," Drilling Contractor, 57(3), pp. 20, 22-23, (May-Jun. 2001).

(Continued)

*Primary Examiner* — Matthew Buck
(74) *Attorney, Agent, or Firm* — Jayne C. Piana

(57) ABSTRACT

Methods and systems for drilling subsea wells bores with dual-gradient mud systems include drilling the subsea well bore while employing a subsea pumping system, a subsea choke manifold and one or more mud return risers to implement the dual gradient mud system. When a well bore influx is detected, the well bore is shut in, and components determine if pressure control may be used to circulate the influx out of the well bore, the size of the influx, and how much the mud system weight will need to be reduced to match the dual gradient hydrostatic head before the influx reaches the subsea pump take point. The subsea pumping system, subsea choke manifold, and mud risers are isolated while the influx is circulated up one or more fluid passages in the drilling riser package using the surface pump, through the wellhead, and out the surface choke manifold.

23 Claims, 10 Drawing Sheets

(56) References Cited

U.S. PATENT DOCUMENTS

| | | | | |
|---|---|---|---|---|
| 4,447,338 | A | 5/1984 | Lundberg et al. | |
| 4,658,904 | A | 4/1987 | Doremus et al. | |
| 5,006,845 | A * | 4/1991 | Calcar et al. | 367/81 |
| 5,029,642 | A | 7/1991 | Crawford | |
| 5,168,932 | A * | 12/1992 | Worrall et al. | 166/336 |
| 5,447,392 | A | 9/1995 | Marshall | |
| 5,873,420 | A | 2/1999 | Gearhart | |
| 5,906,966 | A | 5/1999 | Thaler et al. | |
| 6,003,834 | A | 12/1999 | Read | |
| 6,053,252 | A | 4/2000 | Edwards | |
| 6,102,125 | A | 8/2000 | Calder | |
| 6,216,799 | B1 * | 4/2001 | Gonzalez | 175/5 |
| 6,263,981 | B1 * | 7/2001 | Gonzalez | 175/5 |
| 6,276,455 | B1 * | 8/2001 | Gonzalez | 166/357 |
| 6,328,107 | B1 * | 12/2001 | Maus | 166/335 |
| 6,394,195 | B1 * | 5/2002 | Schubert et al. | 175/69 |
| 6,401,824 | B1 | 6/2002 | Musselwhite et al. | |
| 6,415,877 | B1 * | 7/2002 | Fincher et al. | 175/5 |
| 6,457,528 | B1 | 10/2002 | Staudt | |
| 6,457,529 | B2 * | 10/2002 | Calder et al. | 166/368 |
| 6,474,422 | B2 * | 11/2002 | Schubert et al. | 175/69 |
| 6,484,816 | B1 | 11/2002 | Koederitz | |
| 6,530,437 | B2 | 3/2003 | Maurer et al. | |
| 6,536,540 | B2 | 3/2003 | de Boer | |
| 6,619,388 | B2 | 9/2003 | Dietz et al. | |
| 6,648,081 | B2 * | 11/2003 | Fincher et al. | 175/25 |
| 6,684,957 | B2 | 2/2004 | Allamon | |
| 6,712,145 | B2 | 3/2004 | Allamon | |
| 6,745,857 | B2 | 6/2004 | Gjedebo | |
| 6,755,261 | B2 | 6/2004 | Koederitz | |
| 6,802,379 | B2 | 10/2004 | Dawson et al. | |
| 6,814,142 | B2 * | 11/2004 | Paulk et al. | 166/250.07 |
| 6,843,331 | B2 | 1/2005 | de Boer | |
| 6,854,532 | B2 * | 2/2005 | Fincher et al. | 175/5 |
| 6,926,101 | B2 | 8/2005 | de Boer | |
| 6,953,097 | B2 | 10/2005 | Seyffert | |
| 7,090,036 | B2 | 8/2006 | de Boer | |
| 7,093,662 | B2 | 8/2006 | de Boer | |
| 7,264,058 | B2 * | 9/2007 | Fossli | 166/367 |
| 7,270,185 | B2 * | 9/2007 | Fontana et al. | 166/358 |
| 7,497,266 | B2 * | 3/2009 | Fossli | 166/358 |
| 7,578,350 | B2 * | 8/2009 | Cooper et al. | 166/368 |
| 7,677,329 | B2 * | 3/2010 | Stave | 175/5 |
| 7,866,399 | B2 * | 1/2011 | Kozicz et al. | 166/367 |
| 7,958,948 | B2 * | 6/2011 | Stave | 175/7 |
| 8,322,460 | B2 * | 12/2012 | Horton et al. | 175/5 |
| 2002/0011338 | A1 | 1/2002 | Maurer et al. | |
| 2002/0108747 | A1 | 8/2002 | Dietz et al. | |
| 2002/0108782 | A1 | 8/2002 | De Boer | |
| 2002/0117332 | A1 | 8/2002 | Dawson et al. | |
| 2002/0139536 | A1 | 10/2002 | Staudt | |
| 2003/0047314 | A1 | 3/2003 | Allamon | |
| 2003/0047315 | A1 | 3/2003 | Allamon | |
| 2003/0062199 | A1 | 4/2003 | Gjedebo | |
| 2003/0066650 | A1 * | 4/2003 | Fontana et al. | 166/358 |
| 2003/0070840 | A1 | 4/2003 | De Boer | |
| 2003/0116324 | A1 | 6/2003 | Dawson et al. | |
| 2003/0168258 | A1 | 9/2003 | Koederitz | |
| 2003/0217866 | A1 | 11/2003 | De Boer | |
| 2004/0060737 | A1 | 4/2004 | De Boer | |
| 2004/0065477 | A1 * | 4/2004 | Paulk et al. | 175/50 |
| 2004/0074635 | A1 | 4/2004 | Collie et al. | |
| 2004/0084214 | A1 | 5/2004 | De Boer | |
| 2005/0023038 | A1 | 2/2005 | Seyffert | |
| 2005/0189115 | A1 | 9/2005 | Rytlewski et al. | |
| 2006/0011354 | A1 | 1/2006 | Logiudice et al. | |
| 2006/0151175 | A1 | 7/2006 | Sundararajan et al. | |
| 2006/0196663 | A1 | 9/2006 | Keller | |
| 2007/0027036 | A1 | 2/2007 | Polizzotti et al. | |
| 2008/0060846 | A1 | 3/2008 | Belcher et al. | |
| 2008/0105434 | A1 | 5/2008 | Orbell et al. | |
| 2008/0115942 | A1 | 5/2008 | Keller et al. | |
| 2009/0084604 | A1 | 4/2009 | Polizzotti et al. | |
| 2009/0090558 | A1 | 4/2009 | Polizzotti et al. | |
| 2009/0090559 | A1 | 4/2009 | Polizzotti et al. | |
| 2009/0091053 | A1 | 4/2009 | Polizzotti et al. | |
| 2010/0006297 | A1 * | 1/2010 | Stave | 166/335 |
| 2010/0018715 | A1 | 1/2010 | Orbell et al. | |
| 2010/0025044 | A1 | 2/2010 | Mckay et al. | |
| 2011/0100710 | A1 * | 5/2011 | Fossli | 175/7 |

OTHER PUBLICATIONS

Furlow, W., "Shell Moves Forward With Dual Gradient Deepwater Drilling Solution," Offshore International., 60(3), pp. 54, 96, (Mar. 2000).

Regan et al., "First Dual-Gradient-Ready Drilling Riser Is Introduced," Drilling Contractor, 57(3), pp. 36-37, (May-Jun. 2001).

Furlow, W., "Shell's Seafloor Pump, Solids Removal Key to Ultra-Deep, Dual Gradient Drilling," Offshore International, 61(6), pp. 54, 106, (Jun. 2001).

Forrest et al., "Subsea Equipment for Deep Water Drilling Using Dual Gradient Mud System," SPE/IADC 67707, Drilling Conference, Amsterdam, Netherlands, Feb. 27, 2001-Mar. 1, 2001, pp. 1-8.

Carlsen et al., "Performing the Dynamic Shut-In Procedure Because of a Kick Incident When Using Automatic Coordinated Control of Pump Rates and Choke-Valve Opening," SPE/IADC Managed Pressure Drilling and Underbalanced Operations Conference, pp. 1-13, (Abu Dhabi, UAE, Jan. 28, 2008-Jan. 29, 2008).

Rasmussen et al., "Evaluation of MPD Methods for Surge-and-Swab Pressures in Floating Drilling Applications", IDAC/SPE 108346, Mar. 28, 2007, pp. 1-11, Society of Petroleum Engineers Inc., United States.

Tenarishydril, "Introducing a New World of Premium Connections", Sep. 2008, pp. 1-6, TenarisHydril, publication city and country unknown.

Perdue, J.M., "Downhole tool minimizes surge", E&P Magazine, Aug. 1, 2002, pp. 1-2, hart, downloaded form the Internet on Jun. 20, 2009, at url http://www.epmag.com/archives/print/3191.htm.

"Well Access Systems," FMC Technologies, 2008.

Hognestad, et al. "Open Sea Workover and Completion Riser Systems," Drilling & Well Technology, Business Briefing: Exploration & Production: The Oil & Gas Review, 2004, pp. 94-96.

Kennedy, J., "First Dual Gradient Drilling System Set for Field Test," Drilling Contractor, 57(3), pp. 20, 22-23 (May-Jun. 2001).

Furlow, W., "Shell Moves Forward With Dual Gradient Deepwater Drilling Solution," Offshore Int, 60(3), pp. 54, 96 (Mar. 2000).

Regan et al., "First Dual-Gradient-Ready Drilling Riser Is Introduced," Drilling Contractor, 57(3), pp. 36-37 (May-Jun. 2001).

Furlow, W., "Shell's Seafloor Pump, Solids Removal Key to Ultra-Deep, Dual Gradient Drilling," Offshore Int., 61(6), pp. 54, 106 (Jun. 2001).

Forrest et al., "Subsea Equipment for Deep Water Drilling Using Dual Gradient Mud System," SPE/IADC Drilling Conference (Amsterdam, Netherlands, Feb. 27, 2001-Mar. 1, 2001).

Carlsen et al., "Performing the Dynamic Shut-In Procedure Because of a Kick Incident When Using Automatic Coordinated Control of Pump Rates and Choke-Valve Opening," SPE/IADC Managed Pressure Drilling and Underbalanced Operations Conference (Abu Dhabi, UAE, Jan. 28, 2008-Jan. 29, 2008) (Abstract only).

Carlsen et al., "Performing the Dynamic Shut-In Procedure Because of a Kick Incident When Using Automatic Coordinated Control of Pump Rates and Choke-Valve Opening," SPE/IADC Managed Pressure Drilling and Underbalanced Operations Conference (Abu Dhabi, UAE, Jan. 28, 2008-Jan. 29, 2008).

PCT International Search Report and Written Opinion of the International Searching Authority issued in corresponding patent application No. PCT/US2010/048239, mailed May 19, 2011, 10 pages.

* cited by examiner

SYSTEMS AND METHODS FOR CIRCULATING OUT A WELL BORE INFLUX IN A DUAL GRADIENT ENVIRONMENT

CROSS-REFERENCE TO RELATED APPLICATIONS

This application claims domestic priority benefit under 35 U.S.C. §119(e) from applicants' provisional patent application Ser. No. 61/241,320, filed Sep. 10, 2009, which is incorporated herein by reference.

BACKGROUND INFORMATION

1. Technical Field

The present disclosure relates in general to drilling offshore wells using dual- and/or multi-gradient mud systems. More particularly, the present disclosure relates to systems and methods for drilling offshore wells using such mud systems, and circulating out influxes, such as, but not limited to influxes known as a "kicks."

2. Background Art

In conventional (non-dual-gradient) drilling of offshore wells, pore pressure is controlled by a column of mud extending from the bottom of the well to the rig. In so-called "dual gradient" drilling methods, which have been developed over the last ten years to drill in deep and ultra-deep waters, the mud column extends only from the bottom of the hole to the mudline, and a column of seawater or other less dense fluid that exerts a lower hydrostatic head then extends from the mudline to the rig. Kennedy, J., "First Dual Gradient Drilling System Set For Field Test," *Drilling Contractor,* 57(3), pp. 20, 22-23 (May-June 2001). These systems use a pump and choke, in some systems a subsea pump and subsea choke manifold or pod, to implement the dual gradient system. The subsea pump is employed near the seabed and is used to pump out the returning mud and cuttings from the seabed and above the BOPs and the surface using a return mud line that is separate from the drilling riser.

Thus there are two broad categories of dual gradient drilling systems: those that use a surface pump and either a surface choke or a subsurface choke (or both) to implement the dual gradient, and those that use a subsea pump and subsea choke manifold (sometimes referred to as a "sensor and valve package").

In all dual gradient systems, a problem that needs to be addressed is how to remove (or "circulate out", or simply "circulate") an "influx" of fluid (gas and/or liquid), such as a "kick", that has entered the dual gradient drilling fluid.

The methods and systems proposed herein are applicable to the second type of dual gradient drilling methods noted above, i.e., dual gradient methods and systems that use a subsea pump to implement the dual gradient system. Although previous research projects have developed equipment and methodologies to drill wells with dual gradient mud systems, the known systems and methods to drill well bores using dual gradient systems and circulate out any well bore influx in a dual gradient environment have not been satisfactory.

U.S. Pat. No. 6,484,816 (Koederitz) appears to describe a conventional single mud weight situation using surface mud pumps, and not a dual gradient situation employing a subsea pumping system. The reference describes methods and systems for maintaining fluid pressure control of a well bore 30 drilled through a subterranean formation using a drilling rig 25 and a drill string 50, whereby a kick may be circulated out of the well bore and/or a kill fluid may be circulated into the well bore, at a kill rate that may be varied. A programmable controller 100 may be included to control execution of a circulation/kill procedure whereby a mud pump 90 and/or a well bore choke 70 may be regulated by the controller. One or more sensors may be interconnected with the controller to sense well bore pressure conditions and/or pumping conditions. Statistical process control techniques may also be employed to enhance process control by the controller. The controller 100 may further execute routine determinations of circulating kill pressures at selected kill rates. The controller may control components utilized in the circulation/kill procedure so as to maintain a substantially constant bottomhole pressure on the formation while executing the circulation/kill procedure. While this reference does describe shutting in the well bore and circulating a kick out of the well bore using a constant bottom hole pressure using a mud pump 90, and a choke 70 or choke manifold, the description clearly calls for using mud pumps "located near the drilling rig 25" (col. 5, lines 45-50), and not subsea pumps.

U.S. Pat. No. 6,755,261 (Koederitz) has essentially the same description as the '816 patent except that the surface mud pump 90 is controlled to provide a varied fluid pressure in a circulation system while circulating a kick out of the well bore when using a conventional drilling mud. There is no mention of drilling using a dual gradient system, or subsea pumping systems to implement either the dual gradient system, or to circulate out an influx such as a kick.

U.S. Pat. No. 7,090,036 (deBoer) describes a system for controlling drilling mud density at a location either at the seabed (or just above the seabed) or alternatively below the seabed of wells in offshore and land-based drilling applications is disclosed. The system combines a base fluid of lesser/greater density than the drilling fluid required at the drill bit to drill the well to produce a combination return mud in the riser. By combining the appropriate quantities of drilling mud with a light base fluid, a riser mud density at or near the density of seawater may be achieved to facilitate transporting the return mud to the surface. Alternatively, by injecting the appropriate quantities of heavy base fluid into a light return mud, the column of return mud may be sufficiently weighted to protect the wellhead. At the surface, the combination return mud is passed through a treatment system to cleanse the mud of drill cuttings and to separate the drilling fluid from the base fluid. The system described uses a separate "riser charging line 100" running from the surface to a subsea switch valve 101 to inject a base fluid into the returning mud either above the mudline or below the mudline. Importantly, it is noted in the description that "the return mud pumps are used to carry the drilling mud to a separation skid which is preferably located on the deck of the drilling rig. The separation skid includes: (1) return mud pumps, (2) a centrifuge device to strip the base fluid having density Mb from the return mud to achieve a drilling fluid with density Mi, (3) a base fluid collection tank for gathering the lighter base fluid stripped from the drilling mud, and (4) a drilling fluid collection tank to gather the heavier drilling mud . . . ." There is thus no mention of a subsea pumping system to implement the dual gradient drilling method, or circulating a lighter fluid down the drill pipe and into the annulus, keeping a constant bottom hole pressure, while using the subsea choke manifold to control the flow to the subsea pump (and thus the bottom hole pressure).

U.S. Pat. No. 7,093,662 (deBoer) is similar in disclosure to the '036 patent, however, there is no discernable difference between the two descriptions. The '662 patent includes system claims (as opposed to method claims in the '036 patent). As such, the '662 fails to be novelty destroying for the same reasons as the '036 patent.

U.S. Pub. Pat. App. No. 2008/0060846 (Belcher et al.) discloses a method for dual gradient drilling, but does not disclose a subsea pumping system. (In the figures, such as FIG. 2, mud pump 60 is located at the surface.)

U.S. Pub. Pat. App. No. 2008/0105434 (Orbell et al.) discloses an "offshore universal riser system" (OURS) and injection system (OURS-IS) inserted into a riser. A method is detailed to manipulate the density in the riser to provide a wide range of operating pressures and densities enabling the concepts of managed pressure drilling, dual density drilling or dual gradient drilling, and underbalanced drilling. This reference is difficult to understand, but seems to disclose a subsea pumping system in FIG. 3*g*. Managed pressure drilling is discussed, as is dual gradient drilling, however, there is no discussion of kicks and how to circulate out kicks. The only mention of uncontrolled pressure events (kicks) is in [0048] as follows: "The OURS System allows Nitrified fluid drilling that is still overbalanced to the formation, improved kick detection and control, and the ability to rotate pipe under pressure during well control events." Therefore, this reference is not enabling to teach methods and systems recited in the present claims, even though a subsea mud pump is disclosed in FIG. 3*g*. The only discussion of FIG. 3*g* is as follows, in [0034]: "FIG. 3*g* shows the system used to enable the DORS (Deep Ocean Riser System)"; and in [0097]: "The OURS and OURS-IS can be used without a SBOP, thus substantially reducing costs and enabling the technology shown in FIG. 3*g*. This FIG. 3*g* also illustrates moving the OURS-IS to a higher point in the riser." There is no disclosure in this reference of diagnosing an influx after shutting in the well to determine if pressure control may be used to circulate the influx out of the well; determining the size of the kick; determining how much the fluid weight will need to be reduced to match the dual gradient hydrostatic head before the influx reaches the subsea pump take point; or circulating a lighter fluid down the drill pipe and into the annulus, keeping a constant bottom hole pressure, and using the subsea choke manifold/"sensor and valve package" to control the flow to the subsea pump (and thus the bottom hole pressure). Nor is there description of pumping sufficient lighter weight fluid into the annulus using a surface pump until the fluid in the annulus has a density less than or equal the density of the balance of the dual gradient system; or isolating the subsea pump and circulating the influx up the drilling riser using the surface pump, through the BOP, and finally out the surface choke manifold.

U.S. Pub. Pat. App. No. 2010/0018715 (Orbell et al.) is a continuation or CIP of the '434 application, and lacks the same features that are lacking in the '434 application.

GB 2 365 044 (Wall et al.) discloses a drilling system which may include a subsea pump to implement a dual gradient drilling method. A light fluid, such as nitrogen, may be injected into a mud return riser. However, the '044 patent does not describe well bore influxes or how to deal with them.

Furlow, W., "Shell Moves Forward With Dual Gradient Deepwater Drilling Solution," *Offshore Int.,* 60(3), pp. 54, 96 (March 2000), discusses Shell's efforts at dual gradient drilling using a subsea pumping system (SSPS) featuring electrical submersible pumps (ESPs) which were well-known in conventional drilling. The stated goal was to implement dual gradient drilling using as much "established technology" as possible. The use of ESPs was possible because a primary separation of larger drill cuttings and gases from the returning mud upstream of the ESPs was made using subsea separators. Gases are vented subsea. The authors state: "The pumps are not required to handle large-sized materials or high-pressure gas during a well control event." In discussing the subsea well control, the author states: "The SSPS uses a subsea choke and vents gas at the seabed. As a result, high-pressure containing equipment is only required upstream of the choke. The pump and return conduit systems are not high pressure. When a gas kick is detected, a preventor will close securing the well. As with a conventional system, the driller will receive sufficient information to allow early kick detection, calculation of the proper weight for the kill mud, and the proper drill pipe/volume schedule to adjust the choke and circulate out the kick." From this description, it is unclear if the author discloses keeping a constant bottom hole pressure, and using the subsea choke manifold to control the flow to the subsea pump (and thus the bottom hole pressure). The authors state that during well control, "the venting pressure is passively controlled to be equal to the ambient seawater pressure", but this is not the same as maintaining a constant bottom hole pressure.

Kennedy, J., "First Dual Gradient Drilling System Set For Field Test," *Drilling Contractor,* 57(3), pp. 20, 22-23 (May-June 2001) describes a joint industry project (JIP) to develop dual gradient drilling employing a subsea mudlift, called subsea mudlift drilling, or SMD. The article describes a test to be conducted on a semi-submersible in a producing field in the Green Canyon area of the Gulf of Mexico. After discussing the difference between conventional drilling and dual gradient drilling, and the advantages of the latter for ultra-deep drilling, the author discusses the components of the SMD, including a drill string valve (DSV), a Subsea Rotating Diverter (SRD) and the Subsea Mudlift Pump. "The Mudlift pumps acts as a check valve, preventing the hydrostatic pressure of the mud in the return lines from being transmitted back to the wellbore. The positive displacement pump unit is powered by seawater, which is pumped from the rig using conventional mud pumps down an auxiliary line attached to the marine riser. The cuttings-laden mud, as well as any other well fluids, will be returned to the rig via another line attached to the riser." Regarding well control, there are several laudatory, but not too descriptive or enabling remarks: "Drilling efficiency and safety is increased because well kicks and lost circulation problems are reduced and less rig 'trouble time' will be experienced" . . . . "Kicks can be circulated out at almost any flow rate"; and "Bottomhole pressure can be varied by adding barite or raising the mud/seawater interface in the riser." Given the disclosure of this document, while there is mention of dual gradient drilling implemented using subsea pumps, and circulating out kicks is discussed, there is no description of the aspect or feature of maintaining a constant bottomhole pressure while circulating out a kick, or using the subsea choke manifold/"sensor and valve package" to control the flow to the subsea pump (and thus the bottom hole pressure). Nor is there description of pumping sufficient lighter weight fluid into the annulus using a surface pump until the fluid in the annulus has a density less than or equal the density of the balance of the dual gradient system; or isolating the subsea pump and circulating the influx up the drilling riser using the surface pump, through the BOP, and finally out the surface choke manifold.

Regan et al., "First Dual-Gradient-Ready Drilling Riser Is Introduced," *Drilling Contractor,* 57(3), pp. 36-37 (May-June 2001) is an article by two of the listed inventors on the above-referenced GB 2 365 044 (Wall et al.), and is largely cumulative of the '044 patent. Indeed, the article actually seems to teach away from the use of subsea pumps (p. 37): "Using a smaller fluid return line increases the velocity of the return flow to 3 times that of the riser without the use of the booster line, making it easier to carry the cuttings out of the well. This would require a high-pressure rotary isolation tool. Combined with nitrogen injection, glass beads or foam, this may eliminate the need for subsea pumps in dual gradient drilling."

Furlow, W., "Shell's Seafloor Pump, Solids Removal Key To Ultra-Deep, Dual Gradient Drilling," *Offshore Int.,* 61(6), pp. 54, 106 (June 2001) is a follow-up article to Furlow's 2000 article, and is largely a re-hash of that article. Kick gas is handled by a subsea mud/gas separator. The separator "eliminates free gas before sending returns to the surface, simplifying well control operations and reducing the volume of gas that is handled at the surface near rig personnel." Accordingly, kicks are not circulated out of the well, but are vented subsea.

Other possibly relevant non-patent literature are Forrest et al., "Subsea Equipment For Deep Water Drilling Using Dual Gradient Mud System," SPE/IADC Drilling Conference (Amsterdam, Netherlands, Feb. 27, 2001-Mar. 1, 2001) (mentions dual gradient drilling systems and subsea pumping to implement the system) and Carlsen et al., "Performing The Dynamic Shut-In Procedure Because of a Kick Incident When Using Automatic Coordinated Control of Pump Rates and Choke-Valve Opening," SPE/IADC Managed Pressure Drilling and Underbalanced Operations Conference (Abu Dhabi, UAE, Jan. 28, 2008-Jan. 29, 2008) (discusses the importance of being able to handle kicks during managed pressure drilling and dual gradient drilling using a "dynamic shut-in" procedure, followed by a procedure using an "automatic coordinated control system" to displace the kick, where the automatic coordinated control system operates the main pumps and the choke valve).

From the above, it becomes clear that any effort to combine the teachings of conventional and dual gradient drilling techniques to circulate out influx events would not lead to predictable results, as it is clear that conventional drilling teaches to use constant bottomhole pressure, while dual gradient drilling appears to prefer varying bottomhole pressure when circulating out kicks—teaching away from each other.

Other patent documents discussing dual gradient drilling include U.S. Pat. Nos. 6,328,107; 6,536,540; 6,843,331; and 6,926,101. There are also known so-called "multi-gradient" mud systems, in which beads having density less than a heavy mud are added to a portion of the heavy mud present in a marine riser. Such mud systems are known (using incompressible beads), for example, from U.S. Pat. Nos. 6,530,437 and 6,953,097. Finally, there have been disclosed so-called "variable density" mud systems employing compressible beads, such as described in published U.S. Pat. App. Nos. 20070027036; 20090090559; 20090090558; 20090084604; and 20090091053. Finally, assignee's co-pending application Ser. No. 12/835,473, filed Jul. 13, 2010, discloses methods and systems for running and cementing casing into wells drilled with dual-gradient mud systems include running casing through a subsea wellhead connected to a marine riser, the casing having an auto-fill float collar, and connecting a landing string to the last casing run. The landing string includes a surface-controlled valve (SCV) and a surface-controlled ported circulating sub (PCS). The SCV and PCS are manipulated as needed when running casing, washing it down while preventing u-tubing on connections and prior to cementing to displace mixed density mud from the landing string and replace it with heavy-density mud prior to circulating below the mudline thus maintaining the dual gradient effect. The methods and systems described in the present disclosure are applicable to all of these different types of mud systems, and are generally referred to herein simply as "dual gradient mud systems."

The patent and non-patent documents referenced in this document are incorporated herein by reference for their disclosure of multi-gradient and variable gradient mud systems, as well as to illustrate prior approaches to the need to circulate out any well bore influx in a dual gradient environment. Although previous research projects have developed equipment and methodologies to drill wells with dual gradient mud systems, the known systems and methods to drill well bores using dual gradient systems and circulate out any well bore influxes in a dual gradient environment have not been satisfactory. It would be advantageous if systems and methods could be developed that allow a subsea choke manifold to control and later isolate the flow of circulating fluid to the subsea pump while circulating out a well bore influx in a dual gradient environment.

SUMMARY

In accordance with the present disclosure, apparatus, systems and methods are described which allow drilling subsea well bores using dual gradient systems and circulate out any well bore influxes in the dual gradient environment safely and efficiently. Systems and methods of this disclosure allow a subsea choke manifold to control and later isolate the flow of circulating fluid to the subsea pump while circulating out a well bore influx in a dual gradient environment.

A first aspect of the disclosure is a method of drilling a subsea well bore using a drill pipe, a drilling riser package comprising one or more drilling riser conduits fluidly connecting a drilling platform to a subsea wellhead located substantially at the mud line, the wellhead fluidly connecting the riser conduits and a subsea well accessing a subsea formation of interest, and a dual gradient mud system, comprising:

a) drilling the subsea well bore while employing a subsea pumping system, a subsea choke manifold and one or more mud return risers to implement the dual gradient mud system;

b) detecting a well bore influx and shutting in the well bore;

c) determining i) if pressure control may be used to circulate the influx out of the well bore; ii) size of the influx; and iii) how much the mud system weight will need to be reduced to match the dual gradient hydrostatic head before the influx reaches the subsea pump take point;

d) circulating a lighter single gradient kill weight fluid down the drill pipe using a surface pumping system and into an annulus between the drill pipe and the drilling riser, maintaining a constant bottom hole pressure, and using the subsea choke manifold to control flow to the subsea pump and thus maintain the constant bottom hole pressure;

e) pumping a sufficient amount of the lighter single gradient kill weight fluid into the annulus using the surface pumping system and a surface choke manifold until fluid in the annulus has a density sufficient to control the influx or kick and has a density which is equivalent to the dual gradient mud system; and f) isolating the subsea pumping system, subsea choke manifold, and mud risers while circulating the influx up the annulus and/or one or more other fluid passages in the drilling riser package using the surface pumping system, through the wellhead, and out the surface choke manifold.

To replace the lighter single gradient kill weight fluid in the well bore with a new weighted drilling fluid, certain method embodiments may comprise pumping the upper gradient fluid down the drill pipe/drilling riser annulus through the subsea choke manifold using the subsea pumping system; determining the new drilling fluid weight; pumping the new drilling fluid down the drill pipe and up the annulus using the subsea choke manifold and subsea pumping system; and, once the new fluid is pumped around, opening the well and performing a flow check.

In certain methods the drilling platform comprises one or more floating drilling platforms. In certain embodiments the one or more of the floating drilling platforms comprises a spar platform. In certain embodiments the spar platform is selected from the group consisting of classic, truss, and cell spar platforms. Yet other methods may employ a semi-submersible drilling platform.

In certain methods the subsea wellhead comprises a BOP stack. In certain other methods, the subsea wellhead comprises an alternative to a BOP comprising a lower riser package (LRP), an emergency disconnect package (EDP), and an internal tie-back tool (ITBT) connected to an upper spool body of the EDP via an internal tie-back profile, as taught in assignee's co-pending U.S. application Ser. No. 12/511,471, filed Jul. 29, 2009, incorporated herein by reference.

In certain methods, the one or more other fluid passages may be selected from the group consisting of one or more choke lines, one or more kill lines, one or more auxiliary fluid transport lines connecting the wellhead to the drilling platform, and combinations thereof.

Another aspect of the disclosure is a system for drilling a subsea well bore using a drill pipe, a drilling riser package comprising one or more drilling riser conduits fluidly connecting a drilling platform to a subsea wellhead located substantially at the mud line, the wellhead fluidly connecting the riser conduits and a subsea well accessing a subsea formation of interest, and a dual gradient mud system, comprising:

a) a subsea pumping system, a subsea choke manifold and one or more mud return risers to implement the dual gradient mud system;

b) a controller for detecting a well bore influx, shutting in the well bore, determining if pressure control may be used to circulate the influx out of the well bore, determining size of the influx, and how much the mud system weight will need to be reduced to match the dual gradient hydrostatic head before the influx reaches the subsea pump take point;

c) a surface pumping system and a surface choke manifold for circulating a lighter single gradient kill weight fluid down the drill pipe and into an annulus between the drill pipe and the drilling riser, maintaining a constant bottom hole pressure, using the subsea choke manifold to control flow to the subsea pump and thus maintain the constant bottom hole pressure, and for pumping a sufficient amount of the lighter weight fluid into the annulus until fluid in the annulus has a density sufficient to control the influx or kick and has a density which is equivalent to the dual gradient mud system; and d) one or more valves for isolating the subsea pumping system, subsea choke manifold, and mud risers while circulating the influx up the annulus and/or one or more other fluid passages in the drilling riser package using the surface pumping system, through the wellhead, and out the surface choke manifold.

In certain systems of the disclosure the drilling platform comprises one or more floating drilling platforms, for example one or more of the floating drilling platforms may comprise a spar drilling platform, such as a spar platforms selected from the group consisting of classic, truss, and cell spar platforms. In other system embodiments, the drilling platform may comprise a semi-submersible drilling platform.

In certain system embodiments, the subsea wellhead may comprise a BOP stack. In yet other system embodiments, the subsea wellhead may comprise an alternative to a BOP, such as a system comprising a lower riser package (LRP), an emergency disconnect package (EDP), and an internal tie-back tool (ITBT) connected to an upper spool body of the EDP via an internal tie-back profile.

In certain system embodiments, the one or more other fluid passages may be selected from the group consisting of one or more a choke lines, one or more kill lines, and one or more auxiliary fluid flow lines connecting the wellhead and the drilling platform, and combinations thereof.

In certain embodiments, the system may comprise one or more surface control lines (such as ¼ inch (0.64 cm) diameter or ⅜ inch (1.9 cm) diameter or similar steel tubing) providing one or more control connections between the subsea pumping system, subsea choke manifold, and the one or more valves for isolating the subsea pumping system, subsea choke manifold, and mud risers while circulating the influx up the annulus and/or one or more other fluid passages in the drilling riser package using the surface pumping system, through the wellhead, and out the surface choke manifold. In certain embodiments this control may be performed by a "wired" drillpipe, such as the wired drillpipe available from National Oilwell Varco, Inc., Houston, Tex., under the trade designation "INTELLIPIPE." In other embodiments the system comprises one or more density control lines, sometimes referred to herein as "boost lines", fluidly connecting the riser internal space just above the mud line with a source of a relatively low-density mud, wherein the density of the relatively low-density mud is less than the density of the relatively high-density mud, as further explained herein. The term "mixed-density" mud is used to refer to one or more blends maintained in the drilling riser by combining a portion of a high-density mud being pumped from below the mudline to the drilling riser with a portion of a relatively low-density mud being pumped via one or more "boost" lines.

Monitoring pressure in the riser substantially near the mud line may be accomplished by one or more pressure indicators located on and/or in the riser, substantially near the mud line. To prevent an annulus overpressure situation in the largest diameter well casing, especially but not limited to during the circulation of the influx out of the wellbore, one or more annular pressure buildup prevention means may be included in certain embodiments, such means including annular pressure burst discs. (Such sub-systems are known, for example as disclosed in U.S. Pat. No. 6,457,528, assigned to Hunting Oil Products, Houston, Tex., the disclosure of which is incorporated herein by reference.)

The systems and methods described herein may provide other benefits, and the systems and methods of the present disclosure are not limited to the systems and methods noted; other systems and methods may be employed.

These and other features of the systems and methods of the disclosure will become more apparent upon review of the brief description of the drawings, the detailed description, and the claims that follow.

BRIEF DESCRIPTION OF THE DRAWINGS

The manner in which the objectives of this disclosure and other desirable characteristics can be obtained is explained in the following description and attached drawings in which.

Figure 1:
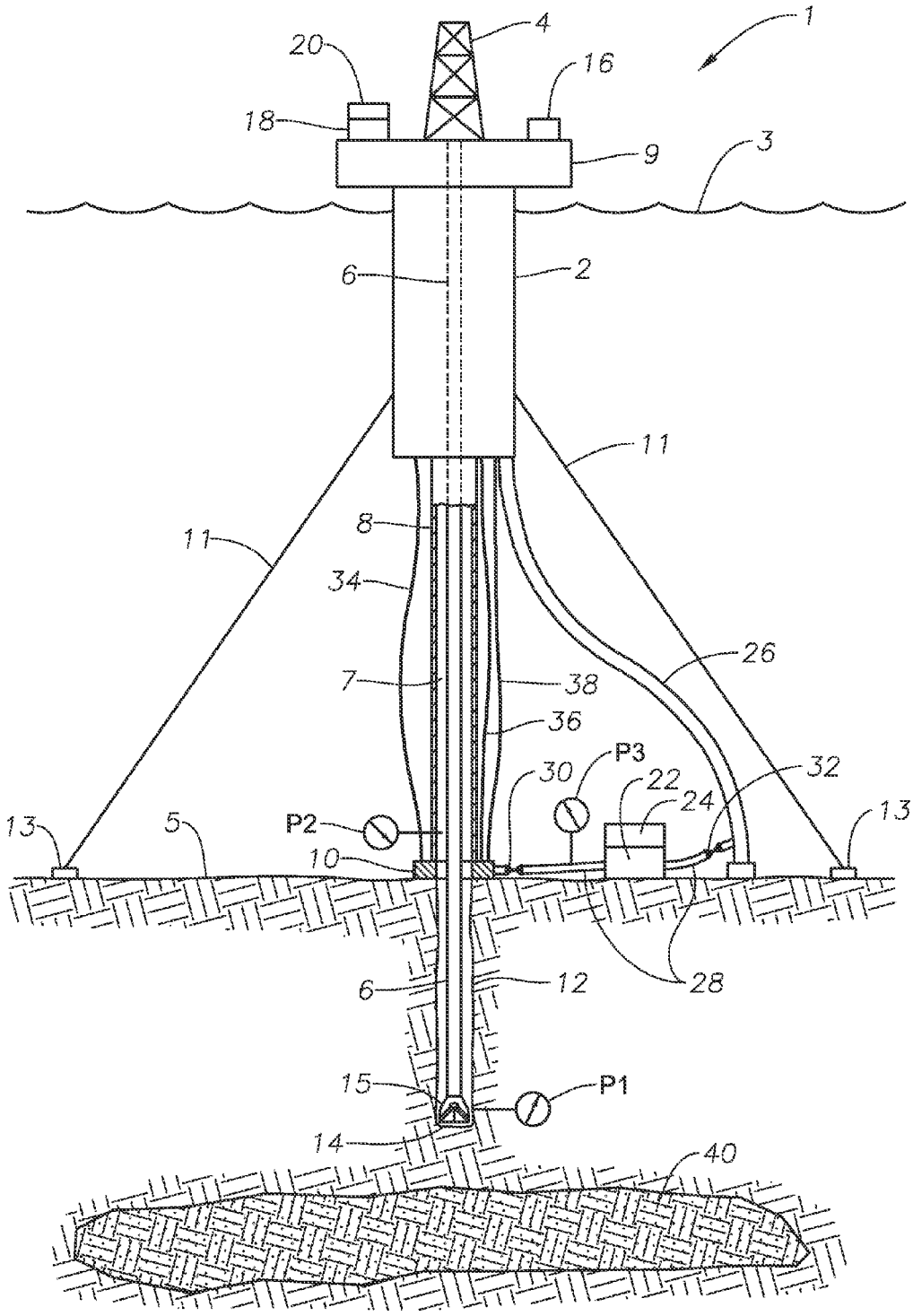
FIGS. 1 and 2 are schematic partial cross-sectional views of two system embodiments within the present disclosure.

It is to be noted, however, that the appended drawings are not to scale, and in some instances do not illustrate all components of a real-world embodiment, and illustrate only typical embodiments of this disclosure, and are therefore not to be considered limiting of its scope, for the systems and methods of the disclosure may admit to other equally effective embodiments. Identical reference numerals are used throughout the several views for like or similar elements.

DETAILED DESCRIPTION

In the following description, numerous details are set forth to provide an understanding of the disclosed methods and apparatus. However, it will be understood by those skilled in the art that the methods and apparatus may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romantic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

As used herein the phrases "relatively low-density mud" and "relatively high-density mud" simply mean that the former has a lower density than the latter when used in the well. The phrase "lighter single gradient kill weight fluid" means a fluid having density less than the relatively low-density mud. In addition, the phrase "mixed-density mud" simply means a mud having a density that is less than the relatively high-density mud, and more than the relatively low-density mud. The relatively high-density mud should have density that is at least 5 percent more than the relatively-low density mud. In certain embodiments, the relatively high-density mud may be 6, or 7, or 8, or 9, or 10, or 15, or 20, or 25, or 30, or more percent higher (heavier) than the relatively low-density mud. The relatively low-density mud may reduce the density of the relatively high-density mud to which it is added by 1 percent, or in some embodiments by 2, or 3, or 4, or 5, or 10, or 15, or 20, or 25, or 30 percent or more. The relatively high-density and the relatively low-density muds may either be water-based or synthetic oil-based muds. As an example, the density of the relatively high-density mud may be about 14.5 pounds per gallon (ppg), the density of the relatively low-density mud may be about 9 ppg, and the mixed-density mud resulting from combining these two muds may range from about 14.0 ppg to about 9.5 ppg, or about 12.8 ppg. In another example, the relatively high-density mud may have a density of about 13.5 ppg, the relatively low-density mud may have a density of about 9 ppg, and the mixed-density mud resulting from combining these two muds may have density of about 11.5 ppg. The lighter single gradient kill weight fluid may be organic or inorganic, and may comprise a relatively low-density mud mixed with another fluid that promotes decreasing the density of the relatively low-density mud.

As noted above, systems and methods have been developed which allow drilling subsea well bores using dual gradient systems and circulate out any well bore influxes in the dual gradient environment safely and efficiently. Systems and methods of this disclosure allow a subsea choke manifold to control and later isolate the flow of circulating fluid to the subsea pump while circulating out a well bore influx in a dual gradient environment, without sacrificing the benefits of the dual gradient mud system already in place in the subsea well from the drilling operation. Systems and methods of this disclosure reduce or overcome many of the faults of previously known systems and methods.

The primary features of the systems and methods of the present disclosure will now be described with reference to FIGS. 1-5, after which some of the operational details will be explained in reference to the logic diagram in FIGS. 6A and 6B. The same reference numerals are used throughout to denote the same items in the figures. In accordance with the present disclosure, a first system embodiment is illustrated in FIG. 1, the dual gradient mud system having been used in drilling the well, as is known. A spar drilling platform 2 (sometimes referred to simply as a "spar") floats in an ocean 3 or other body of deep or ultra-deep water, and is supported by tie-downs 11 and anchors 13. Spar 2 supports a drilling apparatus 4 on a topside 9, which in turn supports a drill pipe 6, the distal end of which has attached thereto a drill bit 15. A drilling riser 8 is illustrated extending from the spar 2 to a wellhead 10, and with drill pipe 6 defines an annulus 7. Wellbore 12 extends from the mudline 5 to the bottom 14 of well bore 12. Topside 9 supports, among other items, a controller 16, a surface pumping system 18, and a surface choke manifold 20. Also illustrated in FIG. 1 is a subsea pumping system 22 and a subsea choke manifold 24, which together with a mud riser 26, low pressure mud lines 28, and isolation valves 30, 32 are used to implement a dual or variable gradient mud system for dual or variable gradient drilling operations. One or more choke lines 34 and one or more kill lines 36, as well as one or more auxiliary fluid flow lines 38 may be provided, depending on the particulars of any embodiment. For example, in dual mud systems, boost lines may be provided, as are known in the art. Boost lines provide the ability to inject a light (low density or low specific gravity fluid, or combination of fluid and solids, into drilling riser 8. In embodiment 1, only a single choke, kill, and auxiliary lines are illustrated for clarity. Drilling proceeds during normal operation toward a subterranean reservoir 40, which may be a hydrocarbon deposit, or other feature of interest. Embodiment 1 also illustrates three pressure gauges P1, P2, and P3, whose use in drilling and removal of well bore influxes will be explained herein.

Figure 2:
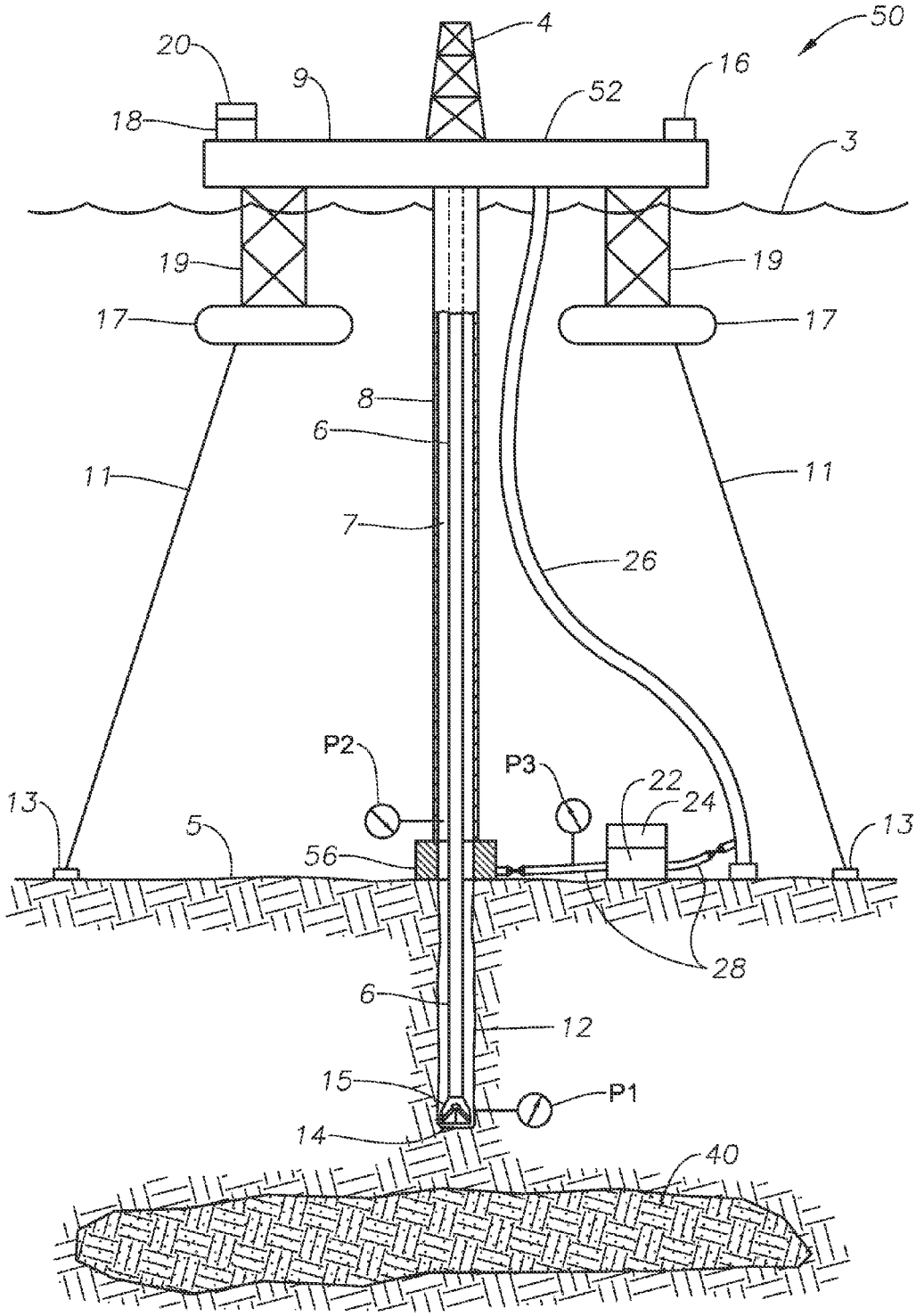

Another system embodiment 50 is illustrated in FIG. 2, which differs from embodiment 1 of FIG. 1 primarily by comprising a more conventional floating platform rather than a spar. The platform of embodiment 50 includes subsea floats 17, which together with supports 19 serve to support topside 9. The combination of floats 17, supports 19, topside 9, an associated topside components (drilling apparatus 4, controller 16, surface pumping system 18, surface choke manifold 20 and other components not shown) are referred to as a floating drilling platform 52. Other embodiments may comprise a semi-submersible platform or ship-shape vessel, as are known in the art.

In embodiment 50 illustrated schematically in FIG. 2, a blowout preventer (BOP) 56 is provided. Other embodiments may comprise, instead of blowout preventer 56, a collection of equipment including a system such as described in assignee's patent application Ser. No. 12/511,471, filed Jun. 29, 2009, published Feb. 4, 2010, as 20100025044, and which is incorporated herein by reference in its entirety. These systems may include: a lower riser package (LRP) comprising a tree connector and a lower spool body, the tree connector comprising an upper flange having a gasket profile for at least one annulus and a seal stab assembly on its lower end for connecting to a subsea tree, means for sealing the lower spool body upon command (in certain embodiments this may be a sealing ram and a gate valve), the lower spool body comprising a lower flange having a profile for matingly connecting with the upper flange of the of the tree connector and an upper flange having same profile; an emergency disconnect package (EDP) comprising an upper spool body having a quick disconnect connector on its lower end, means for sealing the upper spool body upon command (in certain embodiments this may be an inverted sealing ram and a retainer), and at least one annulus isolation valve, the upper spool body having an internal tie-back profile; and c) an internal tie-back tool (ITBT) connected to the upper spool body via the internal tie-back profile.

Figure 3:
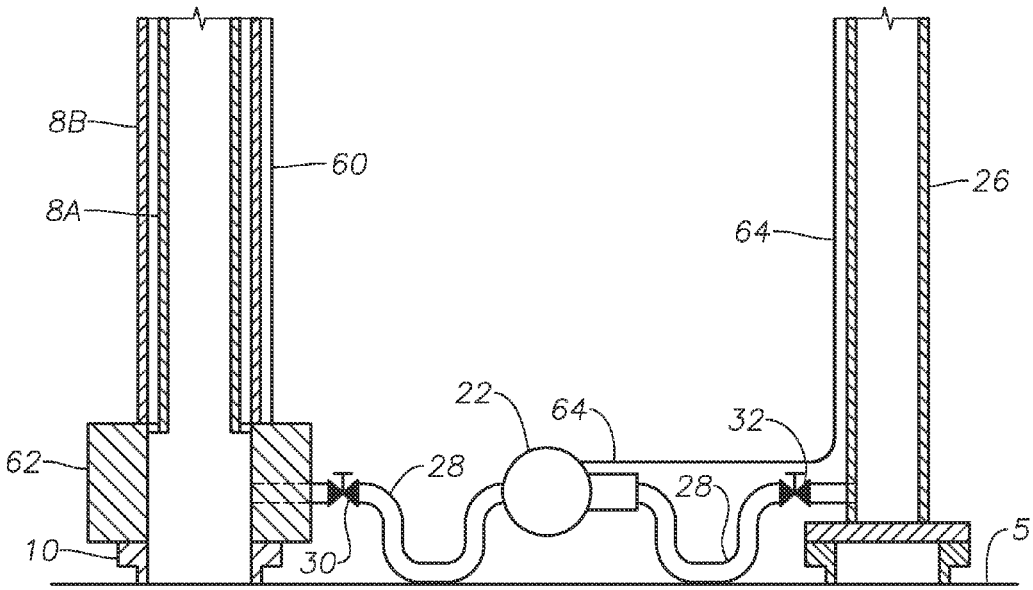
FIG. 3 illustrates a schematic side elevation view, partially in cross-section, of a sub-system and method of the disclosure for implementing a dual gradient mud system in accordance with the present disclosure.

Referring now to FIG. 3, there is illustrated a schematic side elevation view, partially in cross-section, of a sub-system and method of the disclosure for implementing a dual gradient mud system in accordance with the present disclosure. Inner and outer drilling risers 8A and 8B, respectively, are illustrated, along with a control line 60 from the surface connected with a sensor and valve package 62, which in turn is connected to wellhead 10. Also illustrated is mud riser 26 and a power cable 64 which provides power from the surface to mud pumping system 22.

Figure 4:
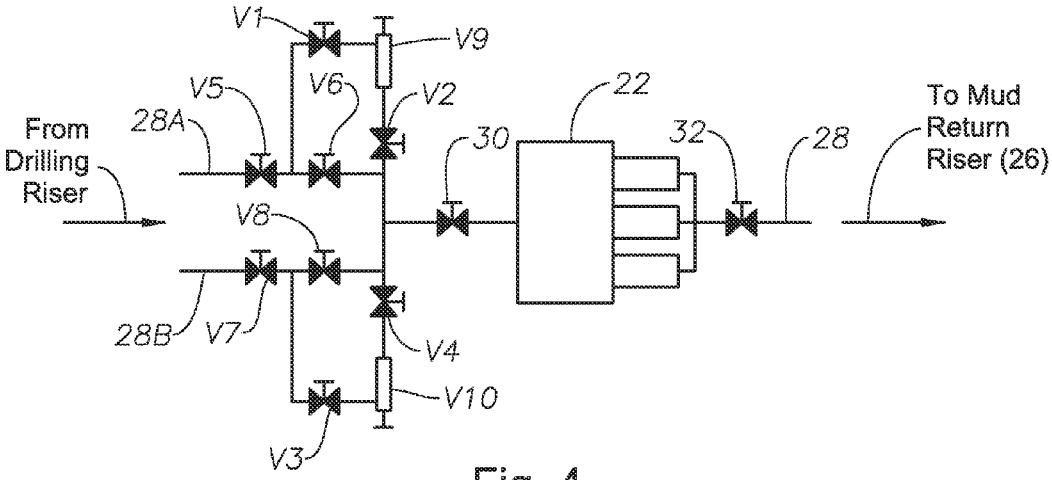
FIG. 4 is a schematic illustration of an embodiment of a subsea pumping system useful in systems and methods of this disclosure.

FIG. 4 is a schematic illustration of an embodiment of a subsea pumping system useful in systems and methods of this disclosure, illustrating one embodiment of a valve package useful in methods of this disclosure. Redundant lines 28A and 28B from drilling riser 8 are illustrated, along with a set of block valves V1, V2, V3, V4, V5, V6, V7, and V8. Choke valves V9 and V10 are also illustrated. It will be appreciated that this embodiment has a number of redundant features, and that other arrangements of valves may be envisioned to accomplish the same purpose, that is, to throttle flow of the dual gradient mud to and through subsea pumping system 22 during normal drilling operations, and to isolate the subsea pumping system and mud return riser 26 from the wellhead 10 and drilling risers 8 during influx circulation steps.

Figure 5A:
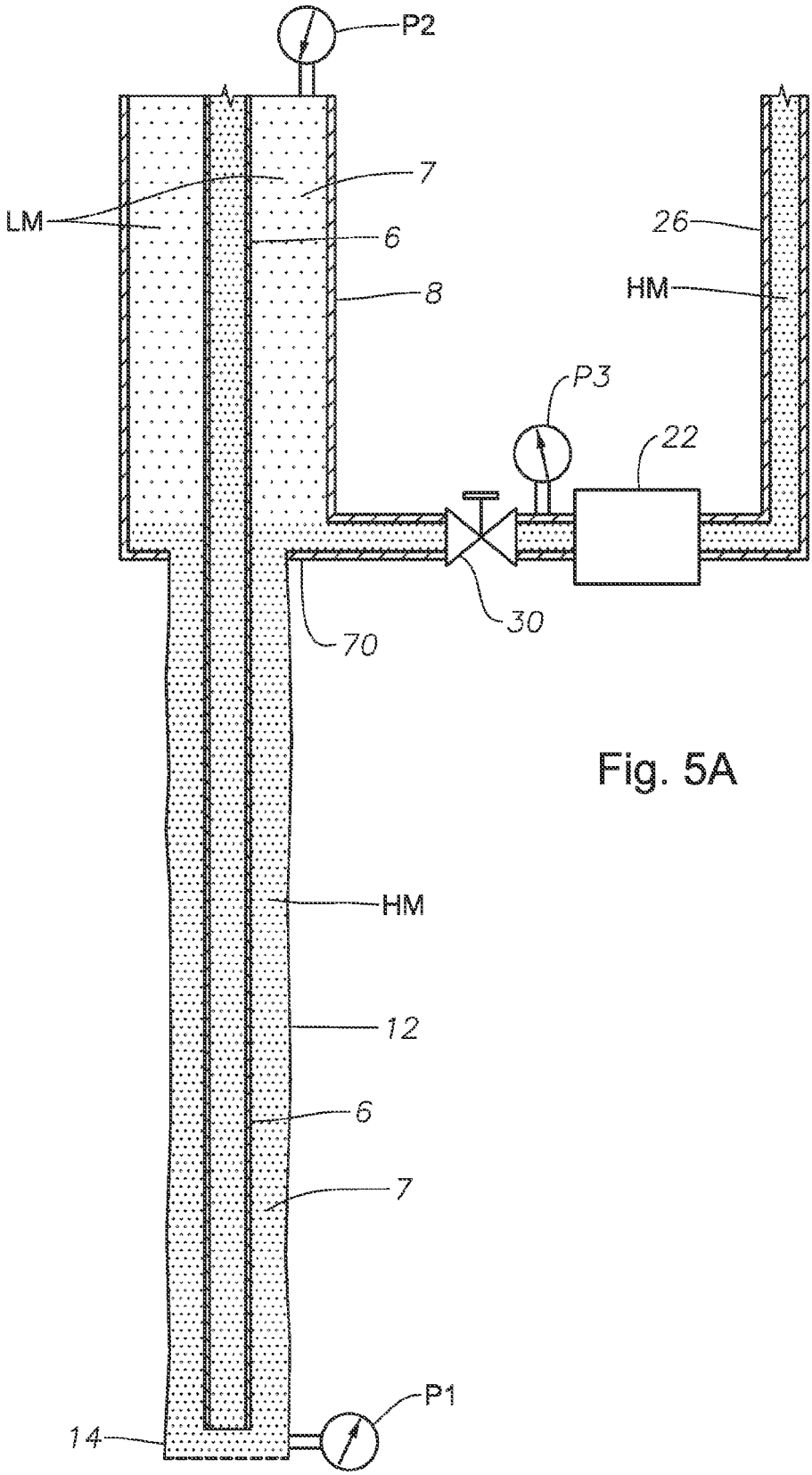
FIGS. 5A-5E are schematic side elevation views, partially in cross-section, of a system and method of this disclosure for circulating out a wellbore influx.

FIGS. 5A-5E are schematic side elevation views, partially in cross-section, of a system and method of this disclosure for circulating out a wellbore influx in a dual gradient drilling environment, where the dual gradient mud system is implemented using a subsea pumping system and subsea choke manifold. FIG. 5A illustrates the system during normal dual gradient drilling, with a relatively low-density mud LM and a relatively high-density mud HM shown in their normal positions in annulus 7. Relatively low-density mud LM is positioned generally above a take point 70 for the subsea pumping system 22, while the relatively high-density mud is illustrated in annulus 7 and inside drill pipe 6 at positions indicated. As is desired, pressure P2 is higher than P1 and P3.

Figure 5B:
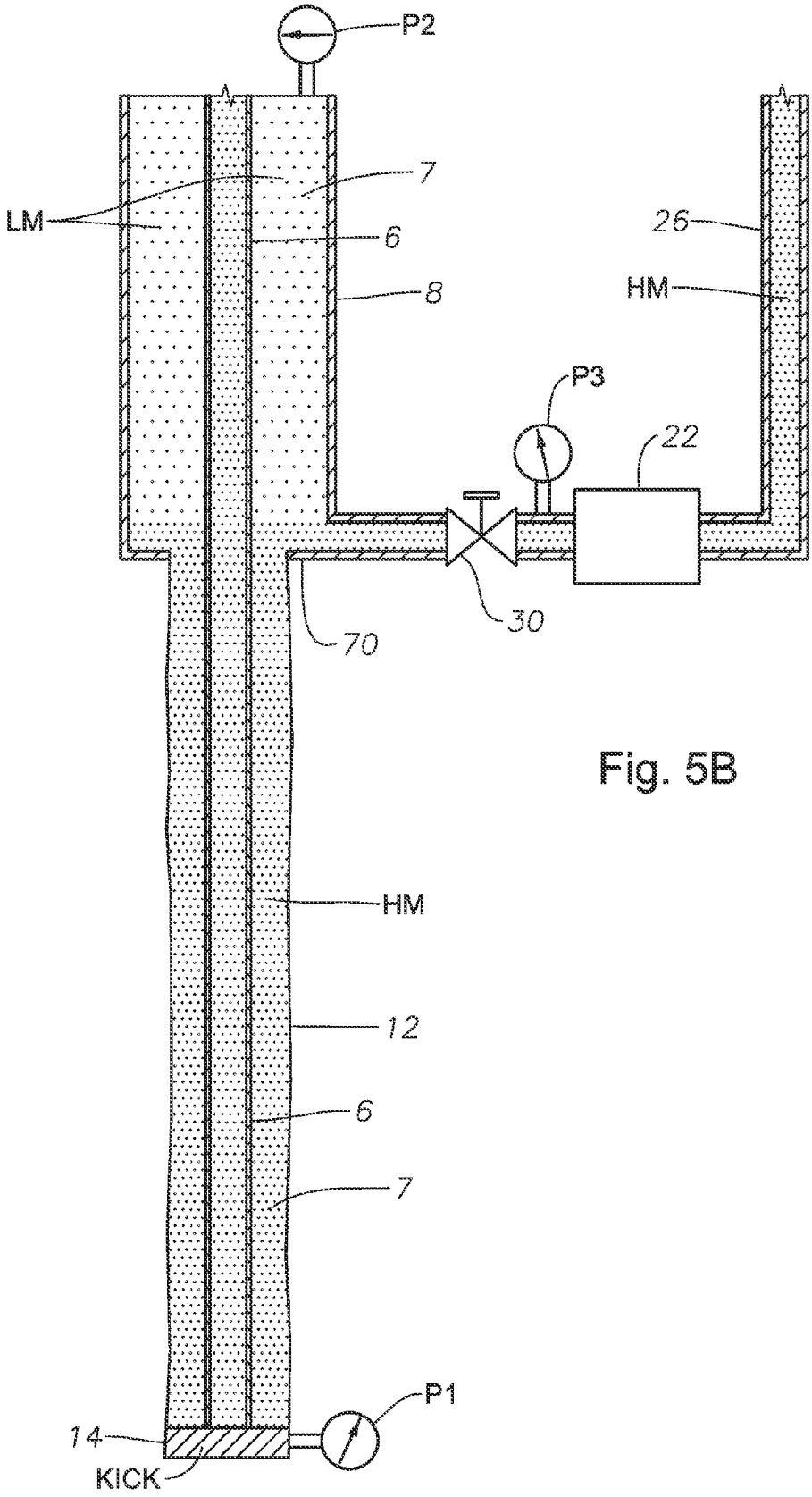
Figure 5C:
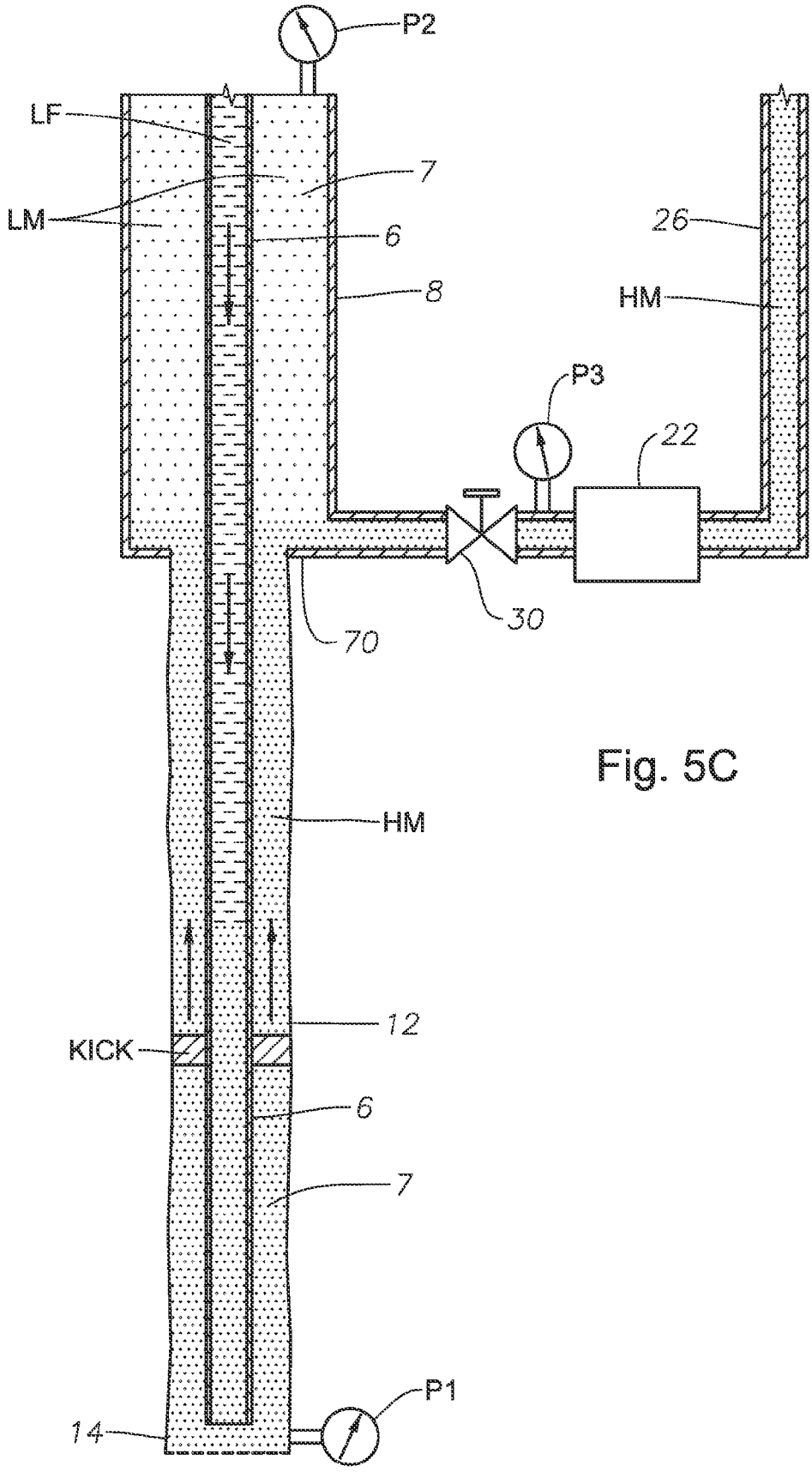
Figure 5D:
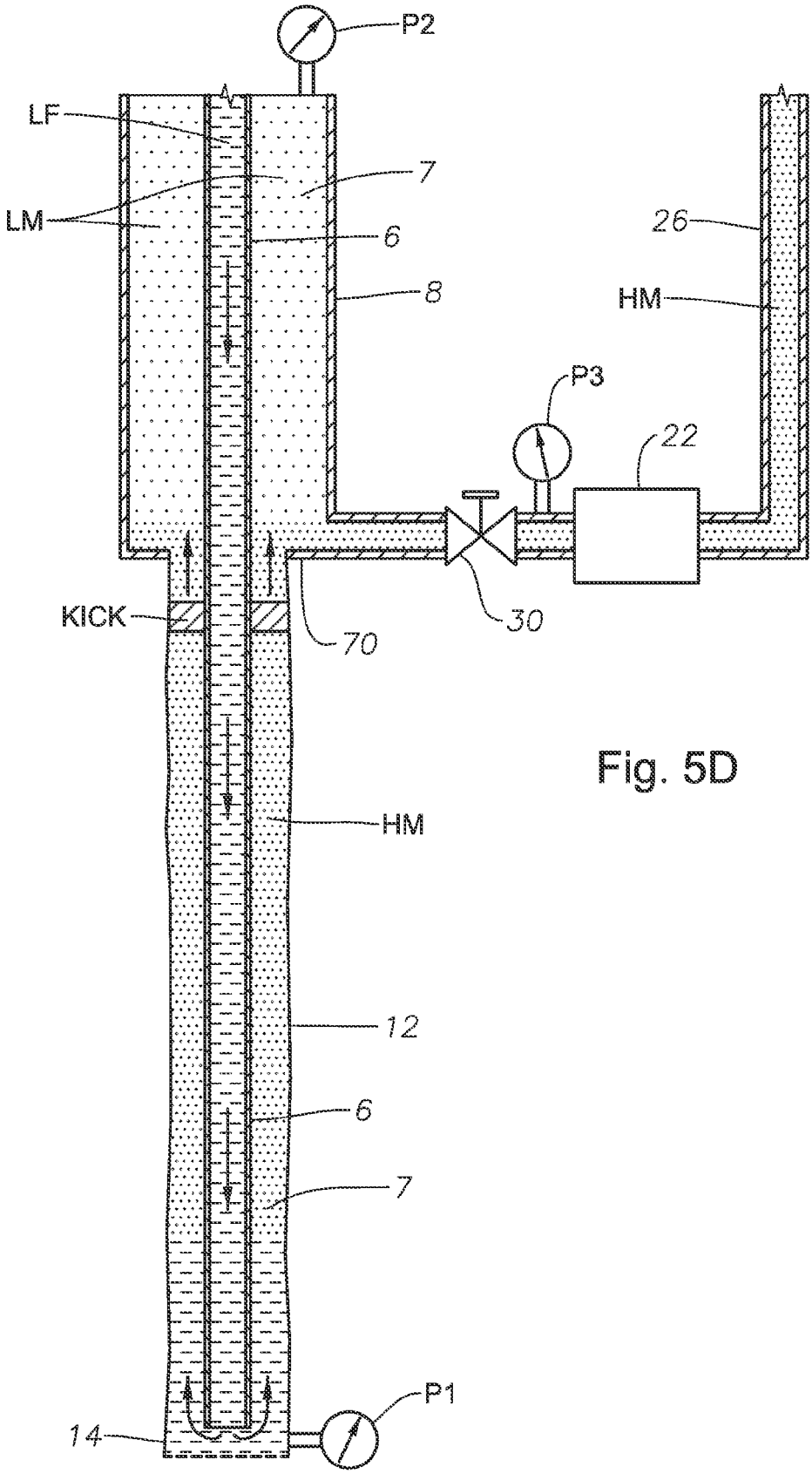
Figure 5E:
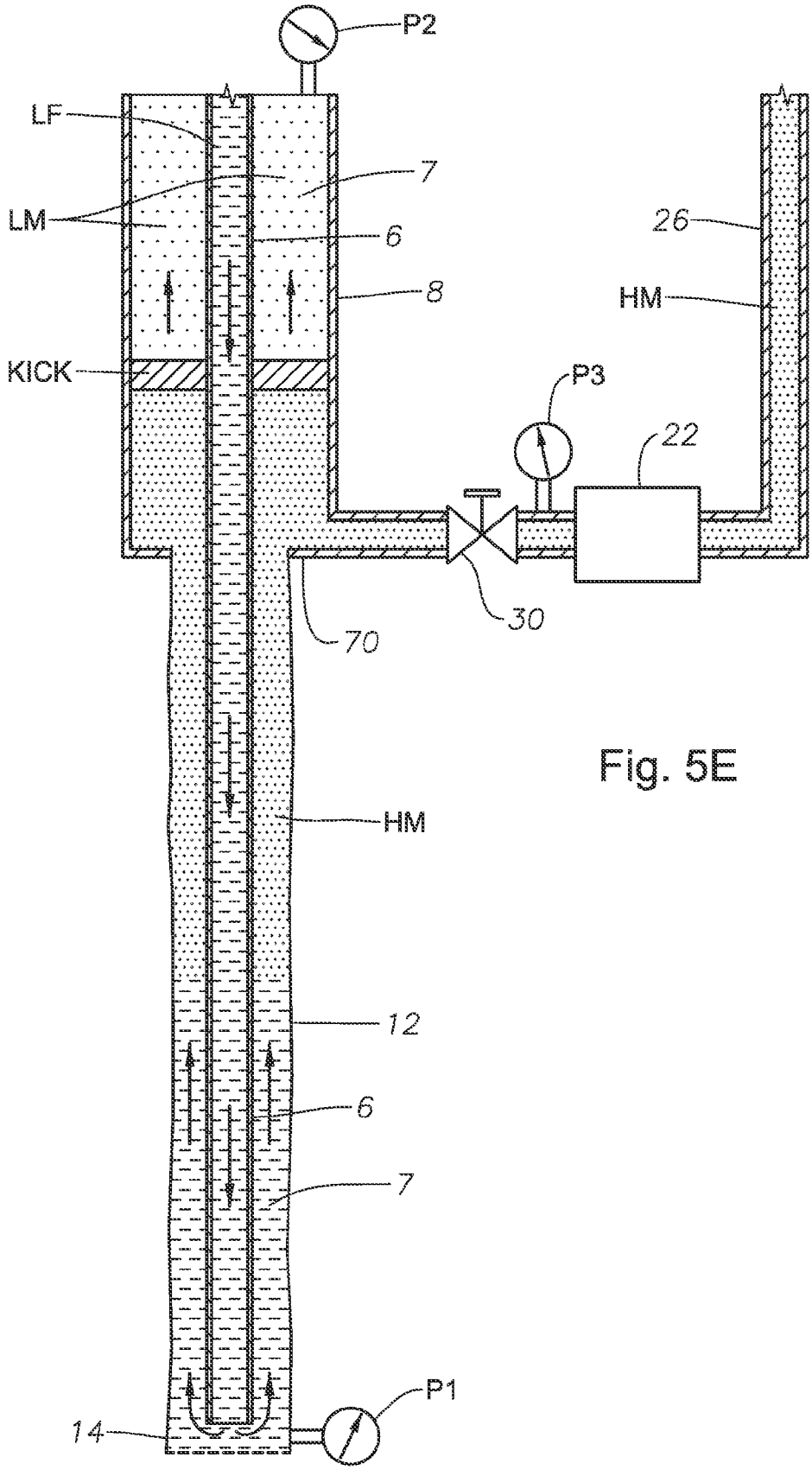

Referring now to FIG. 5B, an unforeseen influx, such as a gas kick, signified as KICK in FIG. 5B, occurs and is detected using typical pressure readings and trend lines read at the surface by the driller. In accordance with the present disclosure, the well bore is immediately shut in, either manually, or more likely by controller 16 (FIGS. 1, 2). Controller 16 determines i) if pressure control may be used to circulate the influx out of the well bore; ii) size of the influx; and iii) how much the mud system weight will need to be reduced to match the dual gradient hydrostatic head before the influx reaches the subsea pump take point 70. Once it is determined that pressure control may be used, and the other parameters are determined (as explained in the Example below), a lighter single gradient kill weight fluid (signified as LF in FIGS. 5C-E) is circulated down drill pipe 6 using the surface pumping system 18 (FIGS. 1, 2) and into the annulus 7 between drill pipe 6 and drilling riser 8, maintaining a constant bottom hole pressure P1. The subsea choke manifold (such as illustrated in FIG. 4, for example) is used to control fluid flow to subsea pumping system 22 and thus maintain the constant bottom hole pressure. A sufficient amount of the lighter single gradient kill weight fluid LF is pumped into annulus 7 using the surface pumping system 18 and surface choke manifold 20 until fluid in annulus 7 has a density sufficient to control the influx or kick and has a density which is equivalent to the dual gradient mud system. The subsea pumping system 22, subsea choke manifold 24, and mud riser 26 are then isolated by closing valve 30 before KICK reaches take point 70 (FIG. 5C), and the influx (KICK) is circulated up annulus 7 (as illustrated in FIGS. 5D and 5E) and/or one or more other fluid passages (not shown for clarity) in the drilling riser package using surface pumping system 18, through wellhead 10, and out surface choke manifold 20.

Figure 6A:
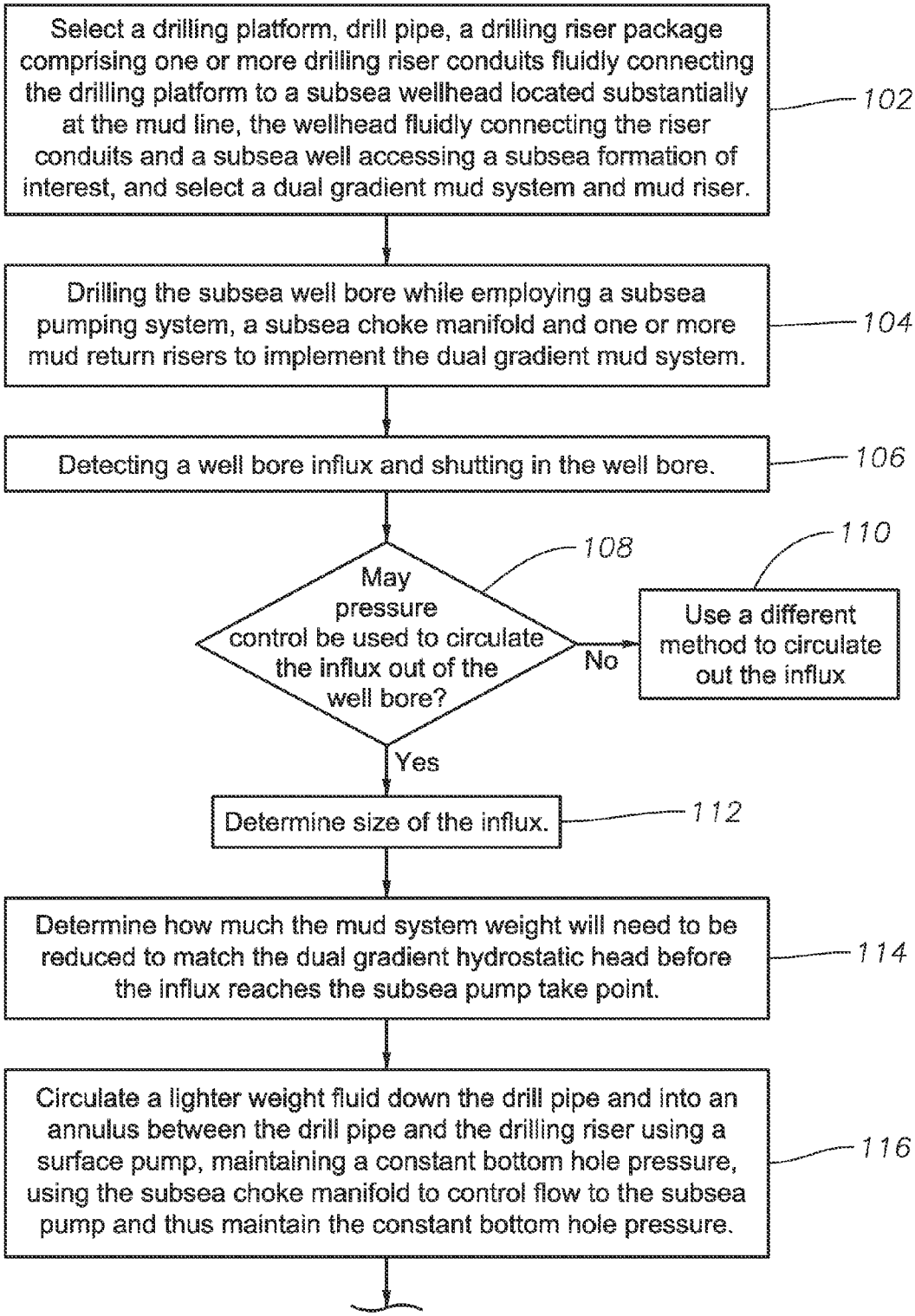
FIGS. 6A and 6B illustrate a logic diagram of one method within the disclosure.
Figure 6B:
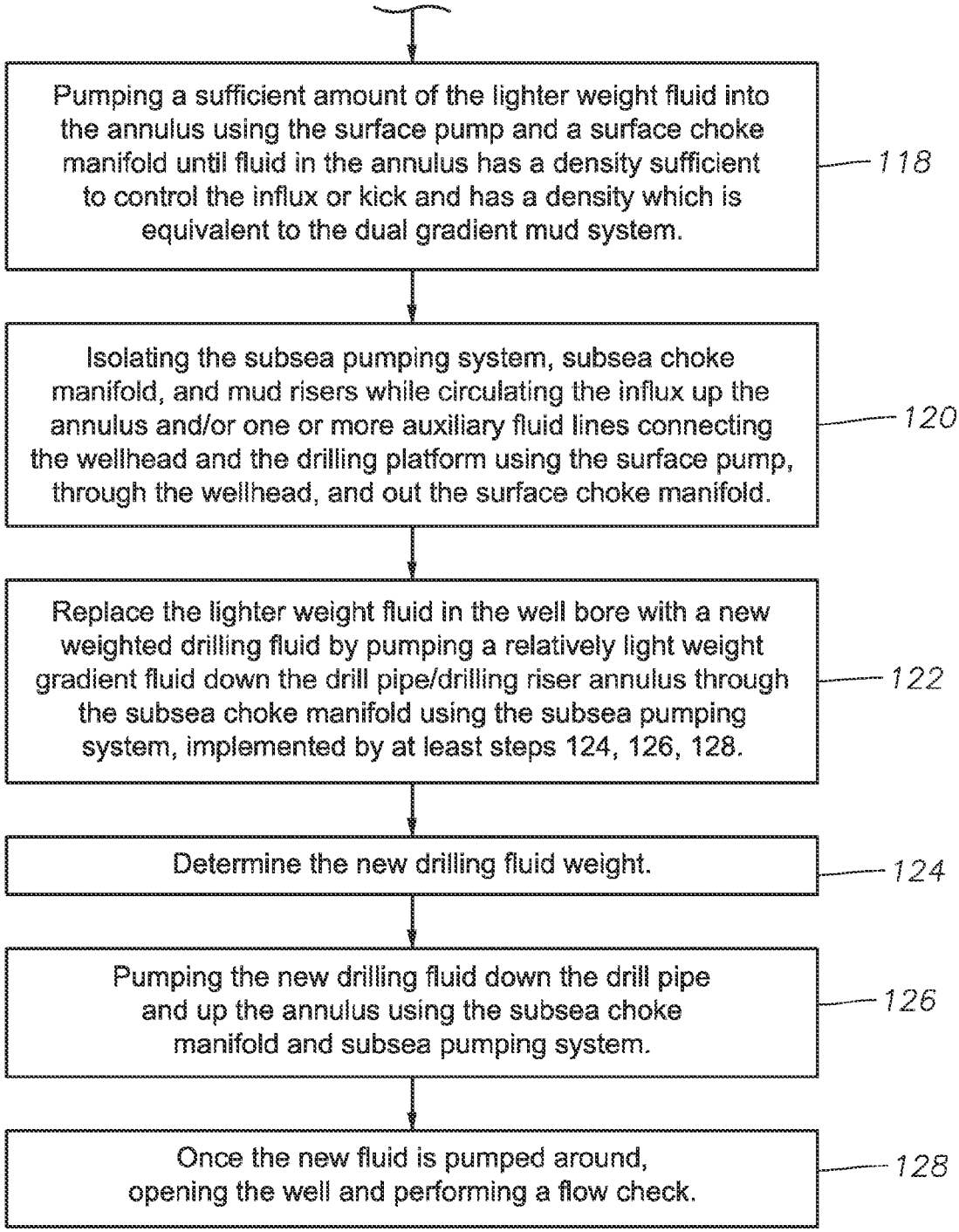

FIGS. 6A and 6B illustrate a logic diagram of one method embodiment within the disclosure. In Box 102, a drilling platform, drill pipe, and a drilling riser package are selected by the driller. The drilling riser package may comprise, in certain embodiments, one or more drilling riser conduits fluidly connecting the drilling platform to a subsea wellhead located substantially at the mud line, the wellhead fluidly connecting the riser conduits and a subsea well accessing a subsea formation of interest. A dual gradient mud system and mud riser are also selected.

In Box 104, drilling the subsea well bore commences while employing a subsea pumping system, a subsea choke manifold and one or more mud return risers to implement the dual gradient mud system. In Box 106, a well bore influx is detected, and the well bore immediately shut in. These operations are typically provided by an automatic controller 16. In decision Box 108, the question is asked whether pressure control may be used to circulate the influx out of the well bore. If yes, then method of the present disclosure may be employed, but if no, other methods may be required, as indicated in Box 110. If yes, then the size of the influx is determined (Box 112) and a calculation is made (Box 114) as to how much the mud system weight will need to be reduced to match the dual gradient hydrostatic head before the influx reaches the subsea pump take point, as explained previously in conjunction with FIGS. 5A-5E.

As depicted in Box 116, a lighter single gradient kill weight fluid LF is circulated down the drill pipe and into an annulus between the drill pipe and the drilling riser using a surface pump, maintaining a constant bottom hole pressure, using the subsea choke manifold to control flow to the subsea pump and thus maintain the constant bottom hole pressure.

As used herein, and in keeping with the terminology used herein above, the fluid LF has a density which is less than the density of the relatively low-density drilling mud (LM) described herein, and in certain embodiments has a density which is much less than the relatively low-density drilling mud LM, and therefore may be described as a relatively very-low-density fluid. For example, the lighter single gradient kill weight fluid LF may have a density that is 90 percent of the density of the relatively low-density drilling mud LM (in other words, density of LF=0.9×(density of LM), or 80 percent of, or 70 percent of, or 60 percent of, or 50 percent of the relatively low-density drilling fluid, or may have an even lower density. The LF may be heated or cooled as desired, for example to prevent formation of hydrates, or to remediate hydrates that have already formed, or for any other end use or purpose, or combination of purposes. In addition, or alternatively, the LF may comprise additives, for example to prevent or remediate hydrates, or for any other purpose or combination of purposes, such as one or more inorganic and/or organic materials in gas, solid, or liquid form, combinations thereof, and the like. Examples of gases may include nitrogen, argon, neon, air, combinations thereof, and the like. Examples of liquids may include glycols, water, hydrocarbons, combinations thereof, and the like. The additives(s) may be combined with the LF at the surface, or be transported separately down to the wellhead and/or other desired injection point in the system to be combined with the virgin LF as desired.

In Box 118, a sufficient amount of the lighter single gradient kill weight fluid LF (with or without any additives as described herein) is pumped into the annulus using the surface pump and a surface choke manifold until fluid in the annulus has a density sufficient to control the influx or kick and has a density which is equivalent to the dual gradient mud system. Then, in Box 120, the subsea pumping system, subsea choke manifold, and mud risers are isolated while circulating the influx up the annulus and/or one or more auxiliary fluid lines connecting the wellhead and the drilling platform using the surface pump, through the wellhead, and out the surface choke manifold.

As depicted in Boxes 122, 124, 126 and 128, the lighter single gradient kill weight fluid LF may be replaced in the well bore with a new weighted drilling fluid. The relatively low-density mud LM may be pumped down the drill pipe/drilling riser annulus 7, through the subsea choke manifold using the subsea pumping system 22. The new drilling fluid weight is computed using known methods, and the new drilling fluid is pumped down the drill pipe 6 and up the annulus 7 using the subsea choke manifold 24 and subsea pumping system 22. Once the new fluid is pumped around, the well is opened and a flow check is performed.

Useful drilling muds or fluids for use in the methods of the present disclosure for the HM and LM fluids, and in certain embodiments the LF, include water-based, oil-based, and synthetic-based muds. The choice of formulation used is dictated in part by the nature of the formation in which drilling is or will be taking place. For example, in various types of shale formations, the use of conventional water-based muds can result in a deterioration and collapse of the formation. The use of an oil-based formulation may circumvent this problem. A list of useful muds would include, but not be limited to, conventional muds, gas-cut muds (such as air-cut muds), balanced-activity oil muds, buffered muds, calcium muds, deflocculated muds, diesel-oil muds, emulsion muds (including oil emulsion muds), gyp muds, oil-invert emulsion oil muds, inhibitive muds, kill-weight muds, lime muds, low-colloid oil muds, low solids muds, magnetic muds, milk emulsion muds, native solids muds, PHPA (partially-hydrolyzed polyacrylamide) muds, potassium muds, red muds, saltwater (including seawater) muds, silicate muds, spud muds, thermally-activated muds, unweighted muds, weighted muds, water muds, and combinations of these.

Useful mud additives include, but are not limited to asphaltic mud additives, viscosity modifiers, emulsifying agents (for example, but not limited to, alkaline soaps of fatty acids), wetting agents (for example, but not limited to dodecylbenzene sulfonate), water (generally a NaCl or $CaCl_2$ brine), barite, barium sulfate, or other weighting agents, and normally amine treated clays (employed as a viscosification agent). More recently, neutralized sulfonated ionomers have been found to be particularly useful as viscosification agents in oil-based drilling muds. See, for example, U.S. Pat. Nos. 4,442,011 and 4,447,338, both incorporated herein by reference. These neutralized sulfonated ionomers are prepared by sulfonating an unsaturated polymer such as butyl rubber, EPDM terpolymer, partially hydrogenated polyisoprenes and polybutadienes. The sulfonated polymer is then neutralized with a base and thereafter steam stripped to remove the free carboxylic acid formed and to provide a neutralized sulfonated polymer crumb. To incorporate the polymer crumb in an oil-based drilling mud, the crumb must be milled, typically with a small amount of clay as a grinding aid, to get it in a form that is combinable with the oil and to keep it as a noncaking friable powder. Often, the milled crumb is blended with lime to reduce the possibility of gelling when used in the oil. Subsequently, the ionomer containing powder is dissolved in the oil used in the drilling mud composition. To aid the dissolving process, viscosification agents selected from sulfonated and neutralized sulfonated ionomers can be readily incorporated into oil-based drilling muds in the form of an oil soluble concentrate containing the polymer as described in U.S. Pat. No. 5,906,966, incorporated herein by reference. In one embodiment, an additive concentrate for oil-based drilling muds comprises a drilling oil, especially a low toxicity oil, and from about 5 gm to about 20 gm of sulfonated or neutralized sulfonated polymer per 100 gm of oil. Oil solutions obtained from the sulfonated and neutralized sulfonated polymers used as viscosification agents are readily incorporated into drilling mud formulations.

The dual gradient mud system may be an open or closed system. Any system used should allow for samples of circulating mud to be taken periodically, whether from a mud flow line, a mud return line, mud motor intake or discharge, mud house, mud pit, mud hopper, or two or more of these, as dictated by circumstances, such as resistivity data being received.

In actual operation, depending on the mud report from the mud engineer, the drilling rig operator (or owner of the well) has the opportunity to adjust the density, specific gravity, weight, viscosity, water content, oil content, composition, pH, flow rate, solids content, solids particle size distribution, resistivity, conductivity, and combinations of these properties of the HM and LM mud in the uncased intervals being drilled. The mud report may be in paper format or electronic format. The change in one or more of the listed parameters and properties may be tracked, trended, and changed by a human operator (open-loop system) or by an automated system of sensors, controllers, analyzers, pumps, mixers, agitators (closed-loop systems).

"Pumping" as used herein for the surface and subsea pumping systems, may include, but is not limited to, use of positive displacement pumps, centrifugal pumps, electrical submersible pump (ESP) and the like.

"Drilling" as used herein may include, but is not limited to, rotational drilling, directional drilling, non-directional (straight or linear) drilling, deviated drilling, geosteering, horizontal drilling, and the like. The drilling method may be the same or different for different intervals of a particular well. Rotational drilling may involve rotation of the entire drill string, or local rotation downhole using a drilling mud motor, where by pumping mud through the mud motor, the bit turns while the drillstring does not rotate or turns at a reduced rate, allowing the bit to drill in the direction it points. A turbodrill may be one tool used in the latter scenario. A turbodrill is a downhole assembly of bit and motor in which the bit alone is rotated by means of fluid turbine which is activated by the drilling mud. The mud turbine is usually placed just above the bit.

"Bit" or "drill bit", as used herein, includes, but is not limited to antiwhirl bits, bicenter bits, diamond bits, drag bits, fixed-cutter bits, polycrystalline diamond compact bits, roller-cone bits, and the like. The choice of bit, like the choice of drilling mud, is dictated in part by the nature of the formation in which drilling is to take place.

Systems and methods of this disclosure may benefit from and interact with conventional sub-systems known in the art. For example, a typical subsea intervention set-up may include a bail winch, bails, elevators, a surface flow tree, and a coiled tubing or wireline BOP, all above a drill floor of a Mobile Offshore Drilling Unit (MODU). Other existing components may include a compensator, a flexjoint (also referred to as a flexible joint), a subsea tree, and a tree horizontal system connecting to wellhead 10. Other components may include an emergency disconnect package (EDP), various umbilicals, an ESD (emergency shut-down) controller, and an EQD (emergency quick disconnect) controller. A conventional BOP stack may be used. A conventional BOP stack may connect to a marine riser, a riser adapter or mandrel having kill and choke connections, and a flexjoint. The BOP stack may comprises a series of rams and a wellhead connector. Conventional BOP stacks are typically 43 feet (13 meters) in height, although it can be more or less depending on the well. Alternatives to the conventional BOP stack have been discussed herein.

Systems within the present disclosure may take advantage of existing components of an existing BOP stack, such as flexible joints, riser adapter mandrel and flexible hoses including the BOP's hydraulic pumping unit (HPU). Also, the subsea tree's existing Installation WorkOver Control System (IWOCS) umbilical and HPU may be used in conjunction with a subsea control system comprising umbilical termination assembly (UTA), ROV panel, accumulators and solenoid valves, acoustic backup subsystems, subsea emergency disconnect assembly (SEDA), hydraulic/electric flying leads, and the like, or one or more of these components supplied with the system.

In accordance with the present disclosure, a primary interest lies in systems and methods for circulating out a well bore influx, such as a kick, in dual gradient environments, using a subsea choke manifold to control and later isolate the flow of circulating fluid to the subsea pump while circulating out a well bore influx in a dual gradient environment, without sacrificing the benefits of the dual gradient mud system already in place in the subsea well from the drilling operation. The skilled operator or designer will determine which system and method is best suited for a particular well and formation to achieve the highest efficiency and the safest and environmentally sound well control without undue experimentation.

EXAMPLE

The following example illustrates, via simulation, a method of the disclosure. Table 1 lists dimensions of two drilling risers, a drill pipe, as well as annular volumes and volume of a typical drill pipe. Table 1 also lists characteristics of a typical dual gradient mud system. Table 1 illustrates the surface gauge pressure and bottom hole pressure (BHP) during circulation of a hypothetical 20 barrel (2.4 $m^3$) kick out of the well using a system and method of this disclosure. As may be seen, for the time of the initial kick to the time the kick reaches the surface, in this simulation, the BHP remains constant at about 21,343 psi (150 MPa), using a lighter single gradient kill weight fluid (designated as "Equiv. Lt Mud" in Table 1) having a density of 14.7 ppg (1.76 kg/L).

From the foregoing detailed description of specific embodiments, it should be apparent that patentable methods and systems have been described. Although specific embodiments of the disclosure have been described herein in some detail, this has been done solely for the purposes of describing various features and aspects of the methods and systems, and is not intended to be limiting with respect to the scope of the methods and systems. It is contemplated that various substitutions, alterations, and/or modifications, including but not limited to those implementation variations which may have been suggested herein, may be made to the described embodiments without departing from the scope of the appended claims.

TABLE 1

Simulated Example of Circulating Out a Kick

| | OD (in) | ID (in) | From (ft) | To (ft) | Section (ft) | Capacity (bbls/ft) | Sect Vol (bbls) |
|---|---|---|---|---|---|---|---|
| Riser | 21.25 | 19 | 0 | 5000 | 5000 | | |
| 13⅝" | 13.625 | 12.25 | 5000 | 18600 | 13600 | | |
| 10⅛" | 10.125 | 8.5 | 18600 | 26200 | 7600 | | |
| OH | 9.625 | 9.625 | 26200 | 28000 | 1800 | | |
| DP | | | | | | | |
| 6⅝" | 6.625 | 5.581 | 0 | 15000 | 15000 | 0.03026 | 453.9 |
| 5⅞" | 5.875 | 5.045 | 15000 | 23200 | 8200 | 0.02473 | 202.7 |
| 5" | 5 | 4.276 | 23200 | 28000 | 4800 | 0.01776 | 85.3 |
| Drill pipe Volume | | | | | | | 741.9 |

TABLE 1-continued

Simulated Example of Circulating Out a Kick

| Annular Volumes | bbls/ft | Length (ft) | Section Vol (bbls) |
|---|---|---|---|
| Riser × 6⅝" | 0.3081 | 5,000.0 | 1,540.3 |
| 13⅝" × 6⅝" | 0.1031 | 10,000.0 | 1,031.4 |
| 13⅝" × 5⅞" | 0.1122 | 3,600.0 | 404.1 |
| 10⅛" × 5⅞" | 0.0702 | 4,600.0 | 322.9 |
| 10⅛" × 5" | 0.0459 | 3,000.0 | 137.7 |
| 9⅝" × 5" | 0.0657 | 1,800.0 | 118.3 |
| Annular Vol | | 28,000.0 | 3,554.6 |

| | | |
|---|---|---|
| DP & Ann Vol | 4,296.5 | bbls |
| Circ Time at 3 BPM | 23.9 | hrs |

| Hydrostatic | Mud Wt (ppg) | From (ft) | To (ft) | Section (ft) | Hydrostatic (psi) |
|---|---|---|---|---|---|
| Riser | 8.6 | 0 | 5,000 | 5,000 | 2,236 |
| ML to TD | 16 | 5000 | 28,000 | 23,000 | 19,136 |
| Total | | | | | 21,372 |

| 20 bbl Kick | Kick Equiv (ppg) | Kick Size (ft) | Length (ft) | Hydrostatic (psi) |
|---|---|---|---|---|
| Oh | 7.5 | 20 | 304.4 | 118.7 |
| 10⅛" × 5" | 7.5 | 20 | 435.7 | 169.9 |
| 10⅛" × 5⅞" | 7.5 | 20 | 285.0 | 111.1 |
| 13⅝" × 5⅞" | 7.5 | 20 | 178.2 | 69.5 |
| 13⅝" × 6⅞" | 7.5 | 20 | 193.9 | 75.6 |
| Riser × 6⅝" | 7.5 | 20 | 64.9 | 25.3 |

| Mud Wts Required | Vol (bbls) | Length (ft) | Wt (ppg) | Sect Hyd (psi) |
|---|---|---|---|---|
| Kick | 20 | 65 | 7.5 | 25.35 |
| | | 5,000.0 | 8.6 | 2236 |
| Heavy Mud | | 22,935.0 | 16 | 19,081.9 |
| Total | | | | 21,343.3 |
| Equiv Lt Mud | | 28,000.0 | 14.7 | 21,403.2 |

| | | Interval (ft) | Hydro (psi) |
|---|---|---|---|
| **Initial Kick** | | | |
| Surface Gauge | | | 14.72 |
| Riser | 8.6 | 5,000.0 | 2,236.0 |
| | 16 | 0.0 | 0.0 |
| Heavy Mud | 16 | 22,807.0 | 18,975.4 |
| Kick | 7.4 | 304.4 | 117.1 |
| Heavy Mud | 16 | 0.0 | 0.0 |
| Light Mud | 14.7 | 0.0 | 0.0 |
| BHP | | 28,111.4 | 21,343.3 |
| **Kill Fluid to bottom of DP** | | | |
| Surface Gauge | | | 51.0 |
| Riser | 8.6 | 5,000.0 | 2,236.0 |
| | 16 | 0.0 | 0.0 |
| Heavy Mud | 16 | 14,986.8 | 12,469.0 |
| Kick | 7.4 | 178.2 | 68.6 |
| Heavy Mud | 16 | 7,835.0 | 6,518.7 |
| Light Mud | 14.7 | 0.0 | 0.0 |
| BHP | | 28,000.0 | 21,343.3 |
| **Trans from Pump to Riser** | | | |
| Surface Gauge | | | 1,004.4 |
| Riser | 8.6 | 5,000.0 | 2,236.0 |
| | 16 | 0.0 | 0.0 |
| Heavy Mud | 16 | 1,613.2 | 1,342.2 |
| Kick | 7.4 | 193.9 | 74.6 |

TABLE 1-continued

| Simulated Example of Circulating Out a Kick | | | |
|---|---|---|---|
| Heavy Mud | 16 | 7,192.9 | 5,984.5 |
| Light Mud | 14.7 | 14,000.0 | 10,701.6 |
| BHP | | 28,000.0 | 21,343.3 |
| Heavy Mud at Surface | | | |
| Surface Gauge | | | −108.6 |
| Riser | 16 | 0.0 | 0.0 |
| | 7.4 | 64.9 | 25.0 |
| Heavy Mud | 16 | 7,192.0 | 5,983.7 |
| Kick | 7.4 | 0.0 | 0.0 |
| Heavy Mud | 16 | 0.0 | 0.0 |
| Light Mud | 14.7 | 20,203.0 | 15,443.2 |
| BHP | | 27,459.9 | 21,343.3 |
| Kick at Surface | | | |
| | | | −198.2 |
| Riser | 8.6 | 0.0 | 0.0 |
| | 16 | 0.0 | 0.0 |
| Heavy Mud | 16 | 0.0 | 0.0 |
| Kick | 7.4 | 64.9 | 25.0 |
| Heavy Mud | 16 | 2,408.3 | 2,003.7 |
| Light Mud | 14.7 | 25,527.0 | 19,512.8 |
| BHP | | 28,000.2 | 21,343.3 |
| Kick Circulated out | | | |
| Surface Gauge | | | −59.9 |
| Riser | 8.6 | 0.0 | 0.0 |
| | 16 | 0.0 | 0.0 |
| Heavy Mud | 16 | 0.0 | 0.0 |
| Kick | 7.4 | 0.0 | 0.0 |
| Heavy Mud | 16 | 0.0 | 0.0 |
| Light Mud | 14.7 | 28,000.0 | 21,403.2 |
| BHP | | 28,000.0 | 21,343.3 |

What is claimed is:

1. A method of drilling a subsea well bore using a drill pipe, a drilling riser package comprising one or more drilling riser conduits fluidly connecting a drilling platform to a subsea wellhead located substantially at the mud line, the wellhead fluidly connecting the riser conduits and a subsea well accessing a subsea formation of interest, and a dual gradient mud system including a first mud having a first density and a second mud having a second density greater than the first density, the method comprising:

a) drilling the subsea well bore while employing a subsea pumping system, a subsea choke manifold, and one or more mud return risers to implement the dual gradient mud system;

b) detecting a well bore influx and shutting in the well bore;

c) determining i) a size of the influx; and ii) a reduction in the weight of the mud system to match a hydrostatic head of the dual gradient mud system before the influx reaches a take point of the subsea pump;

d) circulating a single gradient kill weight fluid having a third density less than the first density down the drill pipe using a surface pumping system and into an annulus between the drill pipe and the drilling riser, maintaining a constant bottom hole pressure, and using the subsea choke manifold to control flow to the subsea pump and maintain the constant bottom hole pressure;

e) pumping a sufficient amount of the single gradient kill weight fluid into the annulus using the surface pumping system and a surface choke manifold until fluid in the annulus has a density sufficient to control the influx and has a density equivalent to the dual gradient mud system; and f) isolating the subsea pumping system, the subsea choke manifold, and the one or more mud return risers while circulating the influx up the annulus or one or more other fluid passages in the drilling riser package using the surface pumping system, through the wellhead, and out the surface choke manifold.

2. The method of claim 1 comprising replacing the single gradient kill weight fluid in the well bore with a new weighted drilling fluid.

3. The method of claim 2 comprising pumping the first mud down the annulus through the subsea Choke manifold using the subsea pumping system.

4. The method of claim 3 comprising determining the new drilling fluid weight.

5. The method of claim 4 comprising pumping the new drilling fluid down drill pipe and up the annulus using the subsea choke manifold and subsea pumping system.

6. The method of claim 5 comprising, once the new fluid is pumped around, opening the well and performing a flow check.

7. The method of claim 1 wherein the drilling platform comprises one or more floating drilling platforms.

8. The method of claim 7 wherein one or more of the floating drilling platforms comprises a spar platform.

9. The method of claim 8 wherein the spar platform is selected from the group consisting of classic, truss, and cell spar platforms.

10. The method of claim 1 wherein the drilling platform comprises a semi-submersible drilling platform.

11. The method of claim 1 wherein the subsea wellhead comprises a BOP stack.

12. The method of claim 1 wherein the subsea wellhead comprises an alternative to a BOP comprising a lower riser package (LRP), an emergency disconnect package (EDP), and an internal tie-back tool (ITBT) connected to an upper spool body of the EDP via an internal tie-back profile.

13. The method of claim 1 wherein the one or more other fluid passages are selected from the group consisting of one or more choke lines, one or more kill lines, one or more auxiliary fluid transport lines connecting the wellhead to the drilling platform, and combinations thereof.

14. A method of drilling a subsea well bore using a drill pipe, a drilling riser package comprising one or more drilling riser conduits fluidly connecting a spar drilling platform to a subsea wellhead via a BOP stack or alternative pressure control package located substantially at the mud line, the wellhead fluidly connecting the riser conduits and a subsea well accessing a subsea formation of interest, and a dual gradient mud system including a first mud having a first density and a second mud having a second density greater than the first density, the method comprising:

a) drilling the subsea well bore while employing a subsea pumping system, a subsea choke manifold and one or more mud return risers to implement the dual gradient mud system;

b) detecting a well bore influx and shutting in the well bore;

c) determining i) a size of the influx; and ii) a reduction in the weight of the mud system weigh to match the dual gradient hydrostatic head before the influx reaches a take point of the subsea pump;

d) circulating a single gradient kill weight fluid having a third density less than the first density down the drill pipe and into an annulus between the drill pipe and the drilling riser, maintaining a constant bottom hole pressure, and using the subsea choke manifold to control flow to the subsea pump and maintain the constant bottom hole pressure;

e) pumping a sufficient amount of the single gradient kill weight fluid into the annulus using a surface pump and a surface choke manifold until fluid in the annulus has a density sufficient to control the influx and has a density equivalent to the dual gradient mud system; and f) isolating the subsea pumping system, the subsea choke manifold, and the one or more mud risers while circulating the influx up the annulus using the surface pump, through the wellhead, and out the surface choke manifold.

15. The method of claim 14 comprising replacing the single gradient kill weight fluid in the well bore with a new weighted drilling fluid by a method comprising pumping the first mud down the annulus through the subsea choke manifold using the subsea pumping system; determining the new drilling fluid weight; pumping the new drilling fluid down the drill pipe and up the annulus using the subsea choke manifold and subsea pumping system; and once the new fluid is pumped around, opening the well and performing a flow check.

16. A system for drilling a subsea well bore using a drill pipe, a drilling riser package comprising one or more drilling riser conduits fluidly connecting a drilling platform to a subsea wellhead located substantially at the mud line, the wellhead fluidly connecting the riser conduits and a subsea well accessing a subsea formation of interest, and a dual gradient mud system including a first mud having a first density and a second mud having a second density greater than the first density, the system comprising:

a) a subsea pumping system, a subsea choke manifold and one or more mud return risers to implement the dual gradient mud system;

b) a controller configured to detect a well bore influx, shut in the well bore, determine the size of the influx, and determine how much the mud system weight will need to be reduced to match the dual gradient hydrostatic head before the influx reaches a take point of the subsea pump;

c) a surface pumping system and a surface choke manifold configured to circulate a single gradient kill weight fluid having a third density less than the first density down the drill pipe and into an annulus between the drill pipe and the drilling riser, maintain a constant bottom hole pressure, control flow to the subsea pump and maintain the constant bottom hole pressure, and pump a sufficient amount of the single gradient kill weight fluid into the annulus until fluid in the annulus has a density sufficient to control the influx or kick and has a density which is equivalent to the dual gradient mud system; and d) one or more valves for isolating the subsea pumping system, subsea choke manifold, and mud risers while circulating the influx up one or more fluid passages in the drilling riser package using the surface pumping system, through the wellhead, and out the surface choke manifold.

17. The system of claim 16 wherein the drilling platform comprises one or more floating drilling platforms.

18. The system of claim 17 wherein one or more of the floating drilling platforms comprises a spar platform.

19. The system of claim 18 wherein the spar platform is selected from the group consisting of classic, truss, and cell spar platforms.

20. The system of claim 16 wherein the drilling platform comprises a semi-submersible drilling platform.

21. The system of claim 16 wherein the subsea wellhead comprises a BOP stack.

22. The system of claim 16 wherein the subsea wellhead comprises a lower riser package (LRP), an emergency disconnect package (EDP), and an internal tie-back tool (ITBT) connected to an upper spool body of the EDP via an internal tie-back profile.

23. The system of claim 16 wherein the one or more other fluid passages are selected from the group consisting of one or more choke lines, one or more kill lines, one or more auxiliary fluid transport lines connecting the wellhead to the drilling platform, and combinations thereof.

* * * * *